United States Patent [19]

Colgate

[11] Patent Number: 4,619,112

[45] Date of Patent: Oct. 28, 1986

[54] STIRLING CYCLE MACHINE

[75] Inventor: Stirling A. Colgate, Los Alamos, N. Mex.

[73] Assignee: Colgate Thermodynamics Co., Princeton, N.J.

[21] Appl. No.: 792,689

[22] Filed: Oct. 29, 1985

[51] Int. Cl.[4] ..... F25B 9/00

[52] U.S. Cl. ..... 62/6; 60/526

[58] Field of Search ..... 62/6; 60/517, 520, 526

[56] References Cited

U.S. PATENT DOCUMENTS

| | | | |
|---|---|---|---|
| 1,808,921 | 6/1931 | Frankl . | |
| 3,323,314 | 6/1967 | Dros | 62/6 |
| 3,889,119 | 6/1975 | Whicker et al. . | |
| 3,913,339 | 10/1975 | Berry . | |
| 3,991,585 | 11/1976 | Mulder . | |
| 4,004,421 | 1/1977 | Cowans . | |
| 4,024,727 | 5/1977 | Berry et al. . | |
| 4,036,027 | 7/1977 | Bamberg . | |
| 4,044,567 | 8/1977 | Dix et al. . | |
| 4,078,389 | 3/1978 | Bamberg . | |
| 4,082,138 | 4/1978 | Miedema et al. . | |
| 4,092,829 | 6/1978 | Durenec . | |
| 4,118,943 | 10/1978 | Chellis . | |
| 4,158,293 | 6/1979 | Chellis . | |
| 4,161,866 | 7/1979 | Kamiyama . | |
| 4,206,609 | 6/1980 | Durenec . | |
| 4,244,192 | 1/1981 | Chellis . | |
| 4,248,050 | 2/1981 | Durenec . | |
| 4,259,844 | 4/1981 | Sarcia et al. . | |
| 4,277,947 | 7/1981 | Durenec . | |
| 4,277,948 | 7/1981 | Horn et al. . | |
| 4,281,517 | 8/1981 | Zimmerman et al. . | |
| 4,294,077 | 10/1981 | Sarcia . | |
| 4,294,600 | 10/1981 | Sarcia et al. . | |
| 4,305,741 | 12/1981 | Sarcia . | |
| 4,310,337 | 1/1982 | Sarcia . | |
| 4,345,437 | 8/1982 | Dineen . | |
| 4,350,012 | 9/1982 | Folsom et al. . | |
| 4,359,872 | 11/1982 | Goldowsky . | |
| 4,365,982 | 12/1982 | Durenec . | |
| 4,366,676 | 1/1983 | Wheatley et al. . | |
| 4,372,128 | 2/1983 | Sarcia . | |
| 4,388,808 | 6/1983 | Durenec . | |
| 4,389,849 | 6/1983 | Gasser et al. . | |
| 4,397,156 | 8/1983 | Heisig et al. . | |
| 4,403,478 | 9/1983 | Robbins . | |
| 4,404,808 | 9/1983 | Andeen . | |
| 4,408,456 | 10/1983 | Rauch . | |

(List continued on next page.)

OTHER PUBLICATIONS

"A Simple, First Step to the Optimization of Regenerator Geometry" by Ray Radebaugh and Beverly Louie, Chemical Engineering Science Division National Bureau of Standards, pp. 177–211, May, 1985.

"Heat Transfer and Flow Friction Characteristics of Porous Media" by J. E. Coppage and A. L. London, *Chemical Engineering Progress,* vol. 52, No. 2, pp. 57F–63F, Feb., 1956.

*Stirling Cycle Engine Analysis* by Israel Urieli and David M. Berchowitz, Adam Hilger Ltd., Bristol, 1984.

*Primary Examiner*—Allen M. Ostrager

*Attorney, Agent, or Firm*—Brumbaugh, Graves, Donohue & Raymond

[57] ABSTRACT

The design of a cryogenic regenerator for an isothermal Stirling cycle is based upon separately minimizing the losses due to the static heat mass regenerator material and the thermodynamic losses of the gas transferred through the regenerator. This leads to a sequence of regenerator sections each designed for a given temperature region (temperature difference/temperature=½) where the gas flows in a constant width channel in contact with a smooth channel wall. Two alternate designs are given, one with the channel walls of a thin stainless steel backed up by bands of lead and the second using a special alloy of pure lead and roughly 1% of a heavy soft metal such as bismuth or cesium. The composite banded regenerator leads to an overall efficiency relative to Carnot of 50% at 4° K. and 15 Hz and the special lead alloy regenerator leads to 25% efficiency at 4° K. and 30 Hz. These high efficiencies require an isothermal Stirling cycle drive with a 2:1 compression ratio starting at one atmosphere of helium. This cycle can be best achieved using special isothermal bellows.

30 Claims, 12 Drawing Figures

U.S. PATENT DOCUMENTS 4,412,423 11/1983 Durenec .
4,413,473 11/1983 Moscrip .
4,413,474 11/1983 Moscrip .
4,413,475 11/1983 Moscrip .
4,417,448 11/1983 Horn et al. .
4,418,533 12/1983 Folsom .
4,425,764 1/1984 Lam .
4,428,197 1/1984 Liljequist .
4,429,732 2/1984 Moscrip .
4,429,732 2/1984 Moscrip .
4,455,841 6/1984 Wurm et al. .
4,462,212 7/1984 Knoos .
4,490,974 1/1985 Colgate ..... 60/520
4,514,987 5/1985 Pundak et al. .

STIRLING CYCLE MACHINE

BACKGROUND OF THE INVENTION

The present invention relates to Stirling cycle machines and, more particularly, to a Stirling cycle machine having a novel regenerator construction for improved operating efficiency.

Introduction

Regenerators are used in Stirling cycle refrigeration machines to store the heat of a gas with small reversible loss during each of two phases of an isothermal cycle. If the temperature difference of a cycle is small relative to absolute temperature, such as in domestic heat pumps and refrigerators, the regenerator can be of simple construction, in the sense that the thermal properties of the materials and of the gas remain essentially constant throughout the regenerator. In cryogenic heat pumps where the temperature difference is large, the regenerator is more complex, and the efficiency of the heat pump is more sensitive to the properties of the regenerator. Hence, the present discussion will be primarily directed to cryogenic regenerators with emphasis on all of the various losses, and then a single upper stage regenerator as the ideal for small temperature difference heat pumps will be described.

Cryogenic Regenerators

Typical cryogenic machinery that is available today is exceedingly inefficient at low temperatures and small capacities. Here efficiency is used relative to the ideal Carnot efficiency. For example, suppose one desires 10 milliwatts of cooling for a solid-state sensor at 3° K. The Carnot factor, 3/300, would be 1%, and so the absolute minimum input power would be 1 watt. The typical machinery available on the market today are a factor of 100 to 200 less efficient than the Carnot factor, requiring some several hundred watts of input power to achieve 10 milliwatts of cooling. Larger capacity machinery that give on the order of 1 watt of cooling have roughly 5% of Carnot efficiency.

It is an objective of the present invention to achieve cryogenic efficiencies that are close (e.g., within a factor of 2) of Carnot efficiency, even for very small capacities.

The major source of the inefficiency of Stirling cycle cryogenic machinery is the regenerator. Here a regenerator is a heat exchange device used to conduct the working fluid, i.e., a gas, from the ambient temperature compression volume to the cryogenic temperature expansion volume. The function of the regenerator is to pass this gas reversibly with negligible losses each cycle. The expansion and compression volumes, which are isothermal to the extent feasible, are advantageously constructed using the known technology of bellows or diaphrams with their associated advantages of isothermality, low friction, and lack of contamination. Such construction is described in U.S. Pat. No. 4,490,974. The expansion and compression volumes, however, account for at most a factor of 2 decrease in efficiency in typical cryogenic machinery so that improving the isothermality and frictional losses of the expansion and compression volumes would provide no more than a factor of 2 difference in the overall efficiency. On the other hand this would be a large improvement in small temperature difference heat pumps. A very large factor of improvement in cryogenic (i.e., very low temperature refrigeration) is available only through an improvement of the regenerator itself.

SUMMARY OF THE INVENTION

The foregoing and other shortcomings of the prior art are overcome or at least mitigated, in accordance with the present invention, by providing a Stirling cycle machine with a regenerator having one or more channels each defined by spaced-apart, smooth channel walls supported by wall members having a relatively low longitudinal thermal conductivity and comprising a heat capacity material of a relatively high specific heat. The regenerator has a plurality of longitudinal sections of specified length, and in each section the channels have a uniform predetermined channel wall spacing and thickness of the heat capacity material. In each section of the regenerator, the spacing between the channel walls (channel width), the length of the section, the thickness of the heat capacity material and the construction of wall members are chosen such that the isothermal cycle losses due to (a) wall heat mass, (b) wall longitudinal thermal conduction, (c) wall orthogonal thermal conductivity, (d) gas-wall thermal conductivity, (e) gas-wall friction, and (f) cycle power loss due to finite channel gas volume are all collectively minimized by making all such losses nearly equal to each other.

The regenerator, in accordance with the present invention, is characterized in that the length of each section and the thickness of the heat capacity material in each section progressively decrease in the direction from the expansion (low temperature) chamber to the compression (high temperature) chamber, and the spacing of the channel walls and the lateral extent of the channels in each section progressively increase in the same direction. The wall members of each channel in at least a portion of the regenerator preferably comprise a stepwise-tapered, tubular outer member enclosing a stepwise-tapered inner member, the outer and inner members being positioned, sized and shaped such that an outer surface of the inner member and the inner surface of the outer member define the channel and serve as the channel walls. Where the regenerator is to have more than one channel, it is advantageous to form nested channels with coaxial tubular members.

According to one embodiment of the present invention, at least a certain portion of the wall members forming a channel are made of a homogeneous material having a relatively high specific heat and a relatively low thermal conductivity. For those sections of the regenerator, where the operating temperature of the gas is less than 100° K., the material of the wall members is advantageously an alloy of lead having 0.1% to 1% of either bismuth or cesium. The regenerator also advantageously includes one or more multiple channel end sections situated nearest the compression (high temperature) chamber each comprising rolled stainless steel foil with regularly spaced, parallel corrugations of uniform height enclosed within tubular walls.

According to another embodiment of the present invention, at least a portion of the wall members forming the channels comprise alternating first and second segments. The first segments are made of heat capacity material having a relatively high specific heat and a relatively high thermal conductivity, while the second segments are made of material having a relatively low thermal conductivity. The first segments of each wall member are oppositely disposed with respect to those of the other wall member. The first segments are advantageously made of lead in sections where the mean operating temperature of the gas is less than 50° K. and made of lead or copper in sections where the operating temperature of the gas is higher than 50° K. The second segments are advantageously made of glass of glass foam. In the alternative, the first segments may comprise brass foil or stainless steel foil backed by bands of lead or copper and the second segments consists solely of unbacked brass or stainless steel foil. The ratio of the length of the first segment to that of the second segment is approximately 10:1, and the number of first segments in a section is advantageously greater than 10. The regenerator advantageously includes one or more multiple channel end sections situated nearest the compression (high temperature) chamber each comprising rolled stainless steel foil with regular spaced, parallel corrugations of uniform height enclosed within tubular walls.

The number of sections in each channel and the lengths of sections are advantageously designed, such that the mean temperature of the working gas varies by approximately a factor of two between adjacent sections. Therefore, a regenerator operating between room temperature and 4° K. will have approximately six sections.

It is an objective of the present invention to achieve cryogenic efficiencies that are close (e.g., within a factor of 2) to Carnot effeciency, even for very small sizes.

BRIEF DESCRIPTION OF THE DRAWINGS

For a better understanding of the invention, reference is made to the following detailed description of exemplary embodiments thereof, taken in conjunction with the accompanying drawing, in which.

Throughout the figures of the drawing, the same reference numerals or characters are used to denote like components, portions or features of the illustrated apparatus.

DETAILED DESCRIPTION

Figure 1:
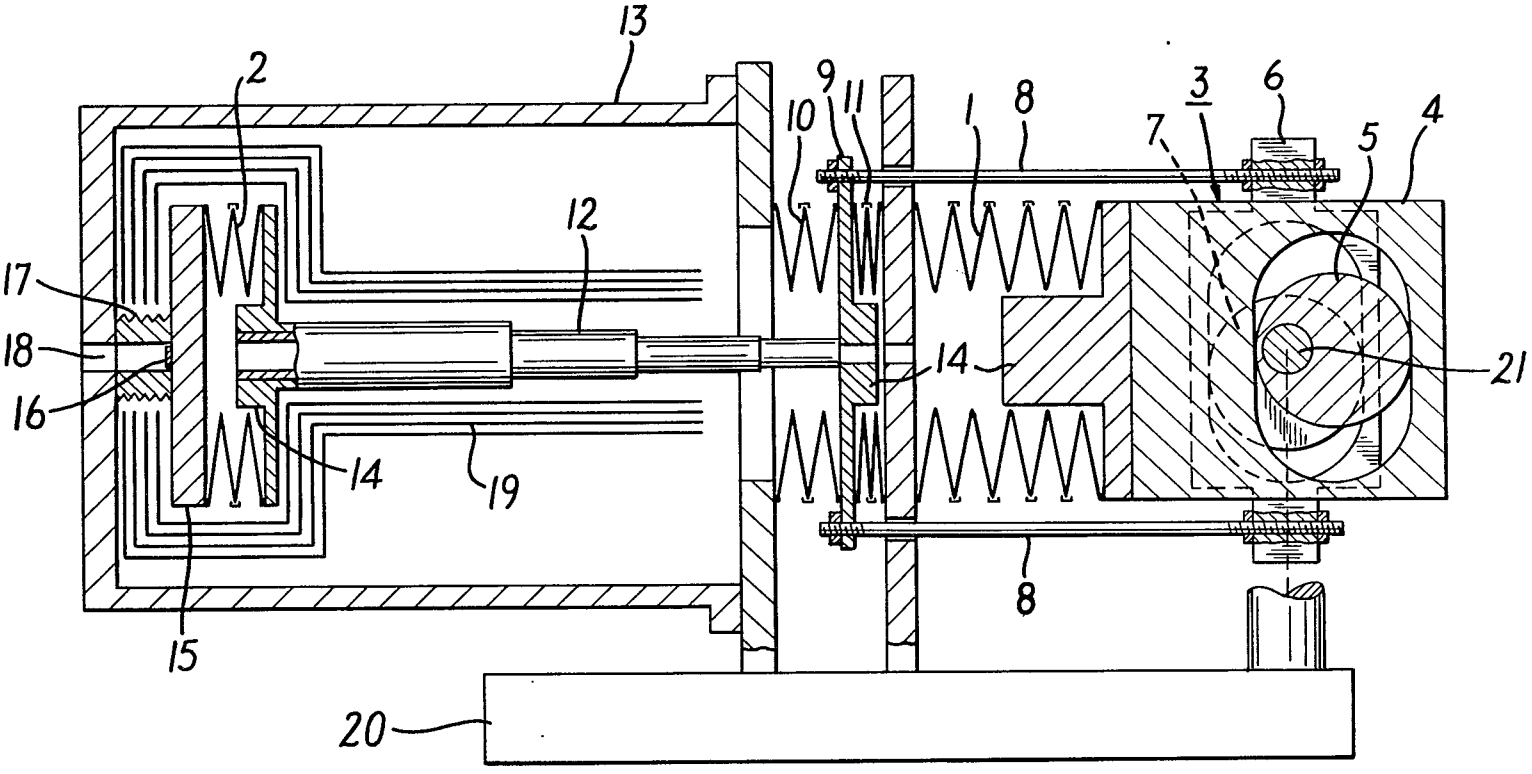
FIG. 1 is a longitudinal sectional view of an entire Stirling cycle refrigerator in accordance with the present invention.

One unique aspect of the regenerator construction of the present invention is related to the simultaneous treatment of all the losses associated with the regenerator. Previous designs of regenerators typically tended to emphasize only the thermal losses and only at the low temperature end. Instead, I have discovered that by taking into consideration the aerodynamics, the cycle losses, and the thermal exchange or conductivity properties of the gas a novel regenerator can be constructed using relatively common materials, like lead or stainless steel, to achieve a high efficiency independent of capacity. The novel regenerator construction of the present invention provides roughly a factor of 100 improvement in efficiency over the current state of the art in regenerators of small capacity, like 1/10 watt at 4° K.

It has not heretofore been recognized that in the design of the regenerator, both cycle and viscous losses should be considered simultaneously with the thermal losses. The combination of all losses represents a five-dimensional space and a minimum of the combination of all losses must be sought in the design at every temperature along the length of the regenerator. In the following design examples, the regenerator is divided into a number of sections, in which there is roughly a factor of 2 change in temperature per section. This means that the properties of the regenerator materials, e.g., the thermal conductivity, specific heat etc., and the properties of the gas e.g., density, temperature, sound speed etc., are approximated to be constant within each section. It will be understood, however, that the design principles described hereinbelow, can be generalized to a continuum design by letting the temperature ratio between sections approach unity, i.e., $\Delta T$ approach zero per stage with a corresponding increase in the number of sections.

Regenerator Section Independence

One critical assumption in the following design analysis is that each regenerator section can be treated independently and that a series of such sections, each with efficiency $eff_i$, gives rise to an overall or total efficiency $Eff_N$ that is the product of the efficiencies of each stage:

$$Eff_N = \prod_{i=1}^{N} eff_i \tag{1}$$

where N is the number of stages in the regenerator. Here efficiency is defined as the ratio of Carnot work to actual work required for a given unit of heat transfer. If the efficiency of each section were not treated independently such that the losses of each section $(1-\mathrm{eff}_i)$ adversely affected the efficiency of a lower temperature section, then the overall losses of the regenerator would become exponentially large and would lead to a naturally limited temperature. The usual assumption is made that the regenerator losses are worse than the product of the efficiencies, and therefore the refrigeration must be distributed along the length of the regenerator in order to make up for cummulative losses in lower stages.

Suppose after i sections a regenerator has a total efficiency $\mathrm{Eff}_i$. If j sections of perfect regenerator (i.e., that of a perfect refrigerator with no losses) are added to the i sections, the pressure volume cycle work at the input of the perfect lower temperature section will be without loss, i.e., $(1-\mathrm{Eff}_j)\mathrm{PdV}=0$ by definition. Therefore, the imperfection (losses) of the upper stages $(1-\mathrm{Eff}_i)$ must be entirely made up by the extra $(1-\mathrm{Eff}_i)\mathrm{PdV}$ work at the input to the upper stages, since there is no other source of work to make up the losses. Thus, the losses of each section are made up by an increment of P dV, and the net refrigeration work is linearly independent stage by stage. As a practical matter, P is nearly constant in all volumes at any one time throughout the cycle, and hence the volume must vary inversely as temperature. This means that a very small displacement volume at the bottom end of the refrigerator (expansion-compression space) will give rise to a large refrigeration effect in the regenerator at the upper end.

The assumption of linear independence of the losses in each section relates to the temperature difference of each section. If the losses in each section are small and, furthermore, if such losses are proportional to the temperature difference of each section, then the approximation to a continum design where the temperature difference of each section approaches zero can be made.

Assuming that the fractional loss, e, is small, a total of nm sections have a loss of e/m per section. If twice as many sections (i.e., m=2), are used, then the total efficiency may be expressed as:

$$\text{total efficiency}=(1-e/m)^{mn}\sim(1-e)^n \tag{2}$$

that is, the total loss is independent of section size. The loss will be proportional to the temperature difference in each section, and consequently e/m is a constant. Hence, a regenerator design in which the temperature difference of each stage is $\frac{1}{2}$ is a rough approximation to a continuum design. The assumption that the properties of the regenerator material and the gas remain approximately constant for the range of temperatures corresponding to the overall temperature difference across the regenerator means that the loss per unit length of any one section is nearly constant. Therefore, all sections could be divided in two, resulting in $2^n$ sections with a loss per section of e/2 and the same total efficiency of $(1-e/2)^{2n}\sim(1-e)^n$.

Finally the loss in each section must be made up by the extra refrigerative work done by the upper stages. There is an additional (second order) loss due to the inefficiency of the refrigeration work necessary to make up for the first order loss. For example, if the loss per stage is (1−eff), then there is the extra refrigerative work necessary to make up for the loss in the nth stage. This work is in turn performed at an efficiency of $(\mathrm{eff})^{(n-1)}$, and the extra input power required is $(\mathrm{eff}-1)/\mathrm{eff}^{(n-1)}$.

The total input power will then be larger for all n stages by $$Eff=\left[\sum_{i=1}^{n-1}(eff_i-1)/eff_i^{(n-1)}\right]+1 \tag{3}$$

This second order loss roughly doubles the total loss for $\mathrm{eff}^n\sim 40\%$ and n=6 stages, or 14% loss per stage. A more accurate derivation of this loss is given in appendix I for a continuum regenerator. The results obtained by the more accurate derivation are comparable to the above.

Measure of Refrigeration

The refrigerative work is proportional to the heat transferred, Q, and inversely proportional to the temperature, T, at which it is transferred. This measure of refrigeration performance or heat transfer difficulty is Q/T, which is the entropy transferred per cycle or per unit of time. The efficiency is the ratio of heat transferred, Q, to the P dV work required to transfer it. Since the volume is proportional to temperature, both Q/T and P dV/T are temperature independent quantities measuring the useful refrigeration. The efficiency per stage is then (Q/T)/(P dV/T) and is the measure of the extra P dV work required to transfer a given entropy Q/T per stage. The losses are the irreversible change in entropy due to friction, conduction, and mixing. Hence, the losses in each regenerator section are assumed independent, and the efficiency is the product of the efficiencies of the sequence of sections. The inefficiency (1−eff) is the fractional loss of P dV work at a given temperature.

Regenerator Function

A regenerator must conduct a gas from a hot region to a cold region and then reverse the flow with negligible cyclic loss of thermal and pressure energy of the gas. It must also not conduct heat from the hot reservoir to the cold reservoir. It is driven by a large volume change at the high temperature end and must transmit more gas in a cycle time than it retains as dead volume. Otherwise, the cycle efficiency becomes too small. These requirements are limited by the following losses:

(1) Thermal conduction in the direction of the primary heat flow, i.e., in the axial direction of the regenerator. Initially it will be assumed that the regenerator material is thermally isotropic. Anisotropic materials will be considered in subsequent examples.

(2) The departure in isothermality due to the finite heat mass of the regenerator material for the storage of heat during the cycle.

(3) The failure of ideal heat exchange between the working fluid gas and the regenerator material.

(4) The extra P dV work and frictional heat due to viscosity leading to a pressure drop along the length of the regenerator from the gas flow.

(5) Cycle loss due to the dead volume of gas within the regenerator which is not active, i.e., does not expand or contract during the cycle. This limits the cycle compression ratio.

Relating these five variables in a fashion that leads to a sensible design is a difficult task, since many of the variable are conflicting. For example, in order to minimize thermal conduction, it is desirable for the heat storage mass to be a minimum so that there is not a great deal of material to conduct heat. On the other hand, it is also desirable for the heat storage mass to be large to store the thermal energy during the cycle. In order to have the heat storage mass small, the frequency of operations should be high so that the heat of the storage mass is used many times per second. Still another consideration is that there should be enough gas flowing through the regenerator to fill an expansion volume or a compression volume in each cycle with an amount that is large compared to that stored within the regenerator itself, i.e., dead volume as opposed to active volume. Otherwise the compression ratio and hence the cycle efficiency becomes too small. This in turn means that for a high operating frequency the gas velocity should be high in order to transfer as large a volume of gas as possible. But high gas velocity leads to a large viscous loss and pressure drop in the regenerator, resulting in waste work and associated heat that short circuits the desired cooling. This combination of concepts is an outline of the conflict among the various losses and gains in the system.

A regenerator design for a small cryogenic heat pump is now considered. It will be assumed that stainless steel is used because of its unique properties, namely strength, low thermal conductivity, ease of fabrication, and inertness. The thermal properties of stainless steel permit a feasible design down to 50° K. without having to resort to more difficult materials, like lead, rare earth metals, or to a anisotropic thermal conduction construction, or to the use of a counter current flow. All of these additional options are available to improve the efficiency of the lower stages of the cryogenic regenerator design. A regenerator design for operating down to 4° K. and the modifications necessary to make a design more efficient will now be described.

It will also be assumed that the working fluid is helium, because only with helium can one hope to obtain the very lowest temperatures in an isothermal regenerative cycle. Hydrogen may be the preferred gas for less extreme temperatures, such as for liquifying air or methane, but the present calculations will be restricted to helium.

The design problem is considered in the following steps:

1. the heat storage vs. thermal conduction loss inherent to the metal properties;
2. the gas thermal contact vs. the regenerator viscous loss, leading to a limiting gas velocity;
3. the dead volume limitation of cycle efficiency and the consequent frequency and length restrictions;
4. the comparison of gas losses to metal losses as a function of temperature and the selection of a design;
5. the channel width and length in order for the gas heat to flow to the walls within the time allowed by the limiting gas velocity;
6. the metal thickness required to store the heat of the gas at the maximum gas velocity and minimum dead volume;
7. the thermal skin depth limitations of the metal mass necessary to store the heat; and
8. the interaction of the sections, channel lateral extent, and heat power.

These limitations will restrict the minimum temperature to $T \sim 50°$ K. for a frequency $f \sim 30$ Hz using stainless steel foil. To achieve a reasonably high overall efficiency of 50% below this temperature requires either a special alloy of lead, a segmented, banded lead construction, or counter current flow. These options allow a lower temperature and higher efficiency. They will be discussed after the simpler design is considered.

To minimize gas friction loss, the regenerator passages must have either a constant or progressively increasing channel width. Otherwise the frequent stopping and starting of the gas in the channel, as is the case with conventional regenerators using lead spheres, will lead to too high a loss of gas kinetic energy, i.e., the friction loss due to gas turbulence becomes too large, as will be discussed in the next section herein.

CHANNEL VERSUS SPHERE TYPE CONSTRUCTION

The viscous loss of the fluid flow in the regenerator produces both a thermal and a pressure loss in each cycle. Extra work is done that produces heat, which in turn requires extra refrigeration to remove. On the other hand, thermal conduction from the gas to the wall is necessary for regenerator action. The viscous loss owing to shear stress is directly related to the thermal conduction, as will be discussed in a later section herein. A dynamic pressure drop due to a change of direction of a fluid element may, however, add to the effective viscous loss but may not add to the heat conduction. Such a condition occurs when a jet expands into a chamber in a turbulent flow. The flow around the lead spheres of conventional regenerators is similar to a series of jets and chambers. As will be explained, an optimum gas velocity is about (1/10) $C_s$, where $C_s$ is the speed of sound in the gas. For helium at 1 atmosphere and room temperature, the optimum gas velocity is on the order of $10^4$ cm $s^{-1}$. The transverse Reynold's number of the jets will then be approximately $Rey \sim 10^4 d$, where d is the jet diameter. Any value of $d > 10^{-2}$ cm, which results in a transverse Reynold's number greater than 100, will lead to sequential jet turbulence and increased viscous loss without providing additional thermal contact. The use of such a small transverse dimension requires channel flow to avoid jet chamber loss. Therefore, a regenerator design with parallel channels is considered, where each channel is of width w and length L. One might naively believe that the effectiveness of a regenerator channel is approximately independent of whether the flow is laminar or turbulent, because the Prandtl number, i.e., the ratio of momentum diffusivity to heat diffusivity (dependent on viscosity and thermal properties), is roughly unity in both cases. However, if a channel varies discontinuously in width as a function of length and the near constant pressure flow has a high Reynold's number, the turbulence induced in the fluid at the discontinuity will dissipate its kinetic energy internally rather than through friction with the wall. Thus the drag coefficient of variable width channel flow can be much greater than that caused by friction with the walls alone. The associated pressure drop occurs at the constrictions, and the resulting expansion, instead of being perfect nozzle flow, is non-recoverable turbulent flow. This property of a fluid flowing through a variable width channel is generally referred to as "choking" and is the basis of fluid switches. Since the pressure drop depends the shape of the channel rather than on wall properties, the thermal transport to the wall is reduced relative to the frictional drag. This is not a desirable property in a regenerator, and therefore the channel of the regenerator must have a near constant cross-section.

Regenerator Temperature Bounds and Number of Sections

The regenerator construction must therefore consist of parallel channels with smooth walls in order to avoid excessive turbulence losses. In addition, the efficiency considerations explained herein will lead to a requirement for the walls of the channels to be mechanically very thin, e.g., less than 0.02 cm. This wall thickness is difficult to achieve by machining, but foil of such thickness can be rolled relatively easily. Hence, production considerations lead to a configuration of parallel channels formed between thin metal strips of constant thickness and each having constant width. Accordingly, the regenerator will have changing gas and metal properties. In order that the thermal efficiency mismatch caused by these changing properties be small, the length of any one regenerator section is limited to a finite temperature ratio, e.g., 2:1. For a maximum temperature $T_{max}$ and a minimum temperature $T_{min}$ in the regenerator section, the temperature ratio is expressed as follows:

$$(T_{max}-T_{min})/T_{max}=\Delta T/T_{max}=\tfrac{1}{2}. \quad (4)$$

Therefore, a minimum temperature of 4° K. would require the number of sections, N, of the regenerator to be equal to $\log_2(300/4)=\log_2(75)\sim 6$. The properties in each section will be derived assuming that the section is at a constant temperature T, where T is the mean temperature of the section. This relatively large temperature difference is an approximation that can later be refined, depending upon the steepness of the temperature dependence of the most important properties.

Metal Heat Storage and Conduction Loss

The stationary parameter of a regenerator is the heat mass of the walls, which usually but not necessarily are made of metal. The heat that can be stored per cycle in the regenerator heat mass is:

$$Q_{stored}=ALC_{metal}(T/n_{TM}), \quad (5)$$

where A is the cross-sectional area of the thermally accessible regenerator material in $cm^2$, L is the length of a given section in cm and $C_{metal}$ is the specific heat per unit volume of the metal at the mean temperature of the section, T. The subscript "metal" is used to unambiguously identify the regenerator heat storage medium.

The mean temperature of the section is centered such that, $$T=2^{\frac{1}{2}}T_{min}=2^{-\frac{1}{2}}T_{max}. \quad (6)$$

The quantity $1/n_{TM}$ is the fractional change in temperature of the metal regenerator section per half cycle, i.e., the regenerator heat mass changes temperature by $\pm T/2n_{TM}$ each cycle. The fractional loss will be less. This temperature variation will lead to an irreversible loss each half cycle. If all other losses are small and the gas is in perfect thermal contact with the metal, the gas from a perfect isothermal expansion-compression volume entering the regenerator at $T_{min}$ will have a maximum temperature difference $\pm T_{min}/2n_{TM}$ from the ideal value $T_{min}$. Similarly, the exiting gas will have a maximum temperature mismatch of $\pm T_{max}/2n_{TM}$. This process of mixing of the two temperature streams is irreversible in that the entropy is increased and is therefore a loss. This loss is measured in units of the fractional loss per cycle of the useful work that would be performed if there were no losses at all. The useful work is proportional to $\Delta T/T$, and the mixing loss is a fraction of this ratio. The mixing loss occurs each half cycle with a mass average value of $T/4n_{TM}$. Hence, the loss per cycle at each end is $T/2n_{TM}$, and the loss at both ends is $T/n_{TM}$.

When two sections of similar thermal properties are joined together, the exiting temperature departure of one section will match the entering temperature departure of the other. Consequently, the thermal lag loss of the regenerator material contributes to the regenerator loss only at the two ends of the whole regenerator. If the thermal properties vary from section to section, the thermal lag loss will be distributed along the length of the regenerator. If the distribution of the loss is monotonic, the total loss will be no greater than if it occurred at the two ends. For that reason $n_{TM}$ is defined such that a generalized $n_T$ may be defined, where $1/n_T$ is the fractional loss or gain in entropy per cycle due to a given effect. Accordingly, the thermal gas loss due to finite metal heat mass for all N sections of the regenerator is:

$$\text{Loss}=(T/n_{TM})\ \text{(gas heat mass) per cycle.} \quad (7)$$

Balanced Metal Losses

The thermal lag loss and metal conduction losses are both thermal losses, which depend oppositely on metal volume, and for that reason compete for metal volume. It is therefore reasonable to assume that an optimum design will be for these two losses to be equal. This is calculated by first assuming isothermal behavior of the regenerator material in the transverse direction. Subsequently, consideration will be given to the thermal skin depth effect to limit the approximation.

The thermal lag loss can be determined from equation (2) by observing that the heat mass of the gas is just the heat stored, $Q_{stored}$, from equation (5). Therefore the thermal lag loss $Q_{thLL}$ per stage may be expressed as:

$$Q_{thLL} = T\,C_{metal}\,A\,L/(n_{TM}^2N), \quad (8)$$

where N is the number of stages. The above expression assumes that the full cross sectional area, A, of the metal contributes to the storage of the gas heat in each cycle. If a thermal skin depth transverse to the direction of heat flow is taken into account, the effective heat mass will be smaller. This skin-depth-limited heat mass is discussed in a later section herein.

The heat conduction loss per cycle may be expressed as:

$$Q_{cond}=KA(\Delta T)/(Lf), \quad (9)$$

where K is the thermal conductivity of the metal and f is the frequency of operation of the refrigerator. Here it is assumed heat flows steadily in the direction of the gas flow and there are no skin depth effects.

The condition of equal losses can be evaluated using the properties of stainless steel and for the mean temperature. The thermal conductivity, K, for stainless steel is approximately $K=2.1\times10^{-4}T$ cal $cm^{-1}\,s^{-1}\,deg^{-1}$ for $T<150°$ K. and $K=2.1\times10^{-3}T^{\frac{1}{2}}$cal $cm^{-1}\,s^{-1}\,deg^{-1}$ for $T>150°$ K. The specific heat per unit volume, $C_{metal}$, for stainless steel is approximately $C_{metal}=2.5\times10^{-5}T^2$cal $deg^{-1}cm^{-3}$ for $T<150°$ K. and $C_{metal}=4.7\times10^{-2}T^{\frac{1}{2}}$cal deg$^{-1}$cm$^{-3}$, for $T>150°$ K. The diffusivity $D_T$ is given by:

$$D_T=K/C_{metal}. \quad (10)$$

For stainless steel, $D_T=8.4T^{-1}cm^{-2}\,s^{-1}$ for $T<150°$ K. and $D_T=0.05T^{-1}cm^{-2}\,s^{-1}$ for $T<150°$ K. Equating the thermal conduction loss to thermal lag loss, the following is obtained:

$$L^2fT = D_T n_{TM}^2 N. \quad (11)$$

For stainless steel and the cryogenic case, i.e., $T<150°$ K., one obtains $L^2fT=4.2n_{TM}^2N$, from which one derives:

$$n_{TM}=0.5L(fT/N)^{-\frac{1}{2}}. \quad (12)$$

The fractional loss may be expressed as:

$$1/(n_{TM}N^{\frac{1}{2}})=2L^{-1}(fT)^{-\frac{1}{2}}. \quad (13)$$

The ratio of heat loss to useful heat per cycle from the combined effects of thermal conduction and finite heat mass per section is obtained by multiplying equation (13) by two.

If no other effects were important, condition (12) could be relatively easily satisfied for stainless steel for temperatures of a few degrees Kelvin. However, when the gas losses are minimized, an additional factor related to the accessible heat mass, namely the thermal skin depth, will have to be taken into account, and consequently the material used at low temperatures will have to be carefully selected.

Regenerator Gas Velocity

It is generally believed that the hydrodynamics of a regenerator is of secondary importance or that the gas flow kinetic energy is trivially small. However, this should not be the case for optimized small or large temperature difference heat pumps. For either of those cases it is desirable to provide the maximum possible heat flux through a given regenerator in order to reduce its gas volume. In that manner the dead volume in an isothermal of Stirling cycle machine is reduced. The heat flux may be maximized by maximizing the gas velocity through the regenerator. The advantageous use of flexure compression or expansion volumes and the requirement of low operating temperatures of less than 4° K. make if necessary to use helium as the working gas at a low pressure of about one atmosphere, since other gases may liquify under such operating conditions. Liquification of the working gas is undesirable in that it reduces the maximum cycle pressure and hence reduces the refrigeration power. The required low pressure at low temperature places a further premium on maximum gas velocity. There is a relatively simple scaling relationship between the gas viscous flow loss versus the gas thermal lag loss due to temperature lag, i.e., the absence of gas thermal conduction to the regenerator mass. As discussed hereinabove, there are two gas thermal lag losses, namely one due to the finite metal heat capacity and the other due to the finite gas thermal conductivity to the metal wall.

As will be further explained hereinbelow, an optimum regenerator design requires laminar flow of the working gas. This will be determined by the requirement to minimize the gas volume in order to minimize the cycle loss. For a laminar flow, the diffusion of heat and momentum in a gas are both governed by the molecular mean free path. The Prandtl number of the gas is defined as the diffusivity of momentum divided by the diffusivity of heat in the gas. For helium the Prandtl number is 0.67, meaning that the diffusivity of heat is roughly 1.5 times greater in helium than the diffusivity of momentum. The diffusivity of momentum is the kinematic viscosity (viscosity/density), which has a value of 1.04 cm$^2$ s$^{-1}$ for helium at 1 atmosphere and 0° C.

Gas Thermal Lag Loss

It is desirable to have the temperatures of the local gas the same as that of the walls in a regenerator, i.e., to have the thermal lag small in that the gas must have many thermal exchange lengths in its passage through the regenerator. Here a thermal exchange length is defined as the distance to exchange the heat of the gas with the walls at the average gas velocity in the channel. If the length of the regenerator is $n_{Tgas}$ exchange lengths, then the residual thermal departure of the gas relative to the wall averaged over a cycle will be roughly half the maximum departure or $\Delta T/2n_{Tgas}$, and the total thermal loss over a full cycle (loss occurs twice per cycle) will be (gas heat mass) $\Delta T/n_{Tgas}$.

Next the viscous heat due to the gas flow must be related to the thermal lag loss due to the finite thermal conduction. The two losses occur as a result of diffusion of momentum and heat, respectively, to the channel walls. The viscous loss is measured as the number of viscous exchange lengths, $n_{vgas}$, in which the kinetic energy of the gas flow is dissipated by friction in a displacement through a regenerator section. The thermal exchange occurs $n_{Tgas}$ times during the same displacement through the regenerator section. Thus the ratio $n_{vgas}/n_{Tgas}$ is equal to the Prandtl number.

On the other hand the loss due to friction is more complicated than the previous definition of thermal efficiency. The heat generated by friction is indeed a direct thermal loss. The P dV work performed to make up for the viscous loss must come from the mechanical input.

Owing to the gain in entropy due to viscous heat, at a given temperature to P dV work required to make up for the viscous heat loss is the same as the P dV work wasted in friction. Hence the total loss due to friction will be equal to the viscous heat plus the viscous mechanical work, which is equal to twice the viscous heat.

It is also desirable to relate the friction loss to the gas velocity in order to relate displacement to dead volume. The pressure drop due to this viscous loss is dependent upon the gas velocity. The maximum velocity associated with this loss can be expressed as a function of sound speed in the gas. A gas moving at its sound speed corresponds to a known kinetic energy or pressure. From thermodynamics the sound speed $C_s$ may be expressed as:

$$C_s=(\gamma P/\rho)^{\frac{1}{2}}, \quad (14)$$

where $\rho$ is the gas density and $\gamma$ is the ratio of the specific heat at constant pressure, $C_p$, to the specific heat at constant volume, $C_v$ ($\rho\pm5/3$ for helium). A gas moving at a velocity of sound speed has a kinetic energy per unit volume, e, of $$e = \rho C_S^2/2 = \gamma P/2 \quad (15)$$

It is desirable to have the viscous pressure drop, ΔP, to be such that the fractional pressure drop, ΔP/P, is:

$$\Delta P/P = \tfrac{1}{2} n_{Tgas} \cdot \mathrm{Tm} \quad (16)$$

Therefore, the combined viscous pressure loss and the viscous heat gives rise to the same fractional heat loss, $1/n_{Tgas}$, as the fractional loss from thermal conduction lag.

The viscous pressure drop times the displacement is the viscous energy loss, which is also equal to the kinetic energy of the gas, $<\rho u^2/2>$, times the number of times it is dissipated, $(\frac{2}{3})\, n_{TGas}$, times the displacement. The factor $\frac{2}{3}$ is the Prandtl number, which is the ratio of viscous to thermal diffusion. Therefore, $$\Delta P = (\tfrac{2}{3}) n_{Tgas} <\rho u^2/2>, \quad (17)$$

where $<\rho u^2/2>$ is the average kinetic energy of the gas per unit volume. When the square of the velocity is averaged across a plane parallel channel, one obtains:

$$<\rho u^2/2> = (8/15)\rho v^2/2, \quad (18)$$

where v is the the time average of $v_{max}$ at the mid-plane (see appendix). The kinetic energy is expressed in terms of a time averaged velocity in order to obtain a mass flux.

One could substitute the gas density, ρ, for helium and solve for ΔP, but it is useful to express the velocity v in terms of sound speed. Therefore, the fractional pressure drop averaged over a cycle may be obtained from equation (17) as:

$$\Delta P/P = [(\tfrac{2}{3})\, n_{Tgas}\, \rho v^2 (4/15)]/(\rho C_S^2/\gamma) \quad (19)$$

Using (16) for $1/n_{Tgas}$, the time average velocity at midplane, v, becomes:

$$v = 1.3 C_s/n_{Tgas} \quad (20)$$

for helium ($\gamma = 5/3$).

In a typical harmonic Stirling cycle $v_{max}^2 \sim 2\, v^2$ so that $$v_{max} = 1.8 C_s/n_{Tgas}. \quad (21)$$

For a typical value of $n_{Tgas}$ of 20 (i.e., 5% loss)

$$v_{max} \sim (1/10) C_s. \quad (22)$$

This velocity is greater than is designed in the usual cryogenic refrigerator. This means one can obtain a greater heat flux at lower pressure, which allows achieving a lower temperature at greater efficiency.

Geometry and Hydrodynamics

In general, thermal conduction loss is the most important loss in cryogenic machinery. As a consequence, it is beneficial to separate thermal losses as a function of length and remove the heat at several temperature increments above the minimum temperature to avoid the large penalty of the Carnot factor. To do this, several expansion volumes (i.e. refrigerators) are distributed along the length of the regenerator. These may be the annular volumes between a stepped displacer and the walls.

One can generalize this concept for flexure machinery as several bellows or diaphrams distributed along the length of the regenerator. However, according to my invention a stepped regenerator having small thermal loss can be made without the need for such distributed refrigerators by making advantageous use of regenerator hydrodynamics, i.e. maximum gas velocity and optimized thermal exchange.

Dead Volume

The volume of gas inside a regenerator reduces the cycle specific energy density. This is because the volume of gas in the regenerator does not participate in the active compression or expansion of the working fluid and thus limits the effective compression ratio. A relatively significant loss of effectiveness occurs if the "dead volume" of the regenerator is greater than the displacement volume. The work, W, done in an isothermal cycle may be expressed as $$W = \int P dv = P_o V_o (\ln C_R), \quad (23)$$

where $V_o$ is the total volume at the high temperature (i.e., room temperature) end, $C_R$ is the compression ratio, which may be expressed as $$C_R = (V_{dead} + V_{displacement})/V_{dead}, \quad (24)$$

where $V_{dead}$ and $V_{displacement}$ are the dead volume and the displacement volume, respectively. If $\ln C_R = 1$, then $W = P_o V_o$.

As the dead volume becomes large compared to the displacement volume, the compression ratio approaches unity and $\ln C_R$ approaches zero. Under those conditions the useful work also approaches zero. The gas is then pumped back and forth and no useful work is performed. The regenerator losses remain unaffected. Hence, for useful cryogenic refrigeration, $\ln C_R$ should approach 1. A higher compression ratio might be energetically advantageous, but is difficult to realize mechanically and thermally. Lower compression ratios will give useful refrigeration, but at cryogenic temperatures where losses are large, it will be important to have $C_R$ as large as feasible. Here a slightly lower but practical compression ratio of 2.0 is chosen, such that $\ln C_R = 0.69$, and one obtains 31% less refrigeration than the ideal case where $C_R = \epsilon$.

In addition, it is likely that the expansion and compression volumes will be driven harmonically by a crankshaft with a given phase difference. Harmonically driven compression and expansion volumes with a phase shift shuttles the gas and compresses it according to the relation $$V = V_o[\sin \omega t + \sin(\omega t + \theta)], \quad (25)$$

where ω is 2π times the driving frequency and θ is the phase shift. Equation (25) assumes no dead volume, and therefore all the gas is shuttled back and forth between the hot and cold volumes. The cold volume will be smaller than the hot volume proportional to 1/T, but the volume ratio is the same as assuming that the temperature at both ends is the same. The compression ratio for the harmonically driven case becomes:

$$C_R = (1 + \cos\theta)/(1 - \cos\theta). \quad (26)$$

It is expected that the cycle efficiency will optimize close to where the phase shift is 90°, in which case the compression ratio for zero dead volume becomes:

$$C_{R90°}=(1+\cos 445°)/(1-\cos 45°)=5.8. \quad (27)$$

The equivalent dead volume of the phase difference of 90° from equation (24) becomes:

$$V_{dead}/V_{displacement}=1/(C_R-1)=0.207. \quad (28)$$

For $C_R=2.0$ the dead volume to displacement volume ratio is:

$$V_{dead}/V_{displacement}=1.0. \quad (29)$$

Therefore, the dead volume to displacement volume ratio permissible in the regenerator is the difference between equations (29) and (28), i.e., $$V_{dead}/V_{displacement}=0.79. \quad (30)$$

This value of the regenerator dead volume ratio will be used to derive the maximum permissible regenerator volume.

Since the gas velocity in each regenerator section is known, the gas displacement volume per unit flow area is determined by the frequency. The dead volume is then the flow area times the length. The regenerator has 6 sections, and the lengths of the sections are designed to be minimum. The combined dead volume limitation and conduction loss will be hardest to satisfy at the low temperature end. Therefore, it is assumed that 50% of the dead volume occurs in the lowest temperature section, and there is an equal dead volume in the remaining 5 sections. Under these conditions, the dead volume of the lowest temperature section is 0.39 times the displacement volume. The displacement volume refers to the high temperature end. Therefore, each of the lower temperature sections must compare its mass of gas in the section to its displaced mass of gas. The gas mass flux through the regenerator is conserved. Therefore, as the temperature decreases, the gas density increases, and the area and velocity decreases, such that $$A_g\rho_g v_c=\text{constant}, \quad (31)$$

where $v_c$ is the time and channel averaged velocity for half a cycle, $A_g$ is the cross-sectional area of gas flow through the regenerator and $\rho_g$ is the average density of the gas in one section. For laminar flow in a plane parallel channel, the velocity is quadratic in distance from the walls and maximum at the mid-plane (see appendix hereinbelow). Then the channel averaged velocity, $v_c$, is $\frac{2}{3}$ the mid-plane maximum. The time averaged mid-plane velocity, v has already been defined in equation (20). Therefore, $v_c=2\,v/3$. For a given section the ratio of dead volume gas mass to displacement volume gas mass, $R_d$, is:

$$R_d=(A_gL\rho_g)/(A_gv\rho_g/4f)=0.39. \quad (32)$$

The displacement volume is equal to the product of velocity, time and $A_g$ and the half cycle time $\tau$ is:

$$\tau=\tfrac{1}{2}f. \quad (33)$$

The mass average velocity across the channel is $v_c$, which from equation (21) may be expressed as:

$$v_c=0.9C_s/n_{Tgas}. \quad (34)$$

Therefore, the dead volume, L $A_g$, is equal to $R_d$ times the displacement volume, where the displacement volume is equal to the product of $v_c$, time and area, i.e., $$V_{dead}=LA_g=R_d(0.9C_s/n_T)(\tfrac{1}{2}f)A_g, \quad (35)$$

from which the section length, L, may be derived as:

$$L = 0.45\ R_d\ C_s\ n_{Tgas}^{-1} f^{-1}\ \text{cm}. \quad (36)$$

For helium $C_s$ may be expressed as:

$$C_s=5800T^{\frac{1}{2}}\text{cm}\ s^{-1}. \quad (37)$$

Thus, the condition for dead volume is:

$$fLT^{-\frac{1}{2}}=2600R_d/n_{Tgas}. \quad (38)$$

With $R_d=0.39$ for the lowest temperature section, equation (38) becomes:

$$fLT^{-\frac{1}{2}}=1000/n_{Tgas}, \quad (39)$$

where f is in hertz, L is in cm, T is in °K.

This condition assumes that the dead volume ratio is one half the maximum ratio, and, for that reason, this condition applies to the lowest temperature section. The combination of all other sections must have a dead volume ratio of 0.39. This ratio for each section is:

$$R_d=4.0\times 10^{-4}Lfn_{Tgas}T^{-\frac{1}{2}}, \quad (40)$$

and the sum of $R_d$ for all the stages above the lowest temperature stage must be less than 0.39.

Gas, Metal, and Dead Volume Losses

The three losses expressed as a fraction of the useful heat transferred are summarized as follows:

$$\text{Gas loss}=2/n_{Tgas}=6.1\times 10^{-4}LfT^{-\frac{1}{2}}R_d^{-1};$$

$$\text{Cycle loss}\sim R_d=4\times 10^{-4}LfT^{-\frac{1}{2}}n_{Tgas};\ \text{and}$$
$$\text{Metal Loss}=1/n_{TM}=2L^{-1}f^{-\frac{1}{2}}T^{-\frac{1}{2}}N^{-\frac{1}{2}}. \quad (41)$$

The cycle loss or dead volume loss is additive section by section, whereas the gas and metal losses lead to a product of efficiencies section by section. The metal loss is not fundamental in the sense that it can be greatly reduced by either designing a counter current flow regenerator or using thermally isolated heat masses, i.e., a thermally anisotropic construction. Therefore, the design will be based upon the fundamental limits of the gas loss and dead volume ratio. The metal loss condition will then be investigated to see if it is satisfied with isotropic stainless steel. If the metal loss condition is not satisfied with stainless steel at the lowest temperature section, it will be determined to what higher temperature section it can be satisfied and the lower temperature sections will then be designed with appropriate anisotropic materials. The problem is how to further reduce the design parameter space in order to arrive at an optimum design.

The dead volume ratio, $R_d$, is chosen as the logical parameter to specify, because the inefficiency is least sensitive to the choice of $R_d$ and the resulting loss is additive section by section rather than dependent on the more sensitive product of efficiencies associated with the other losses.

Length versus Temperature

The dead volume ratio was estimated on the basis that higher temperature sections would contribute a smaller dead volume proportional to $T^{-1}$, so that the sum of the dead volumes of all higher temperature sections would be equal to that of the lowest temperature section. The total dead volume would then be twice that of the lowest temperature section. The resulting particular choice of the section length, L, is:

$$L=L_oT^{-\frac{1}{2}}. \quad (42)$$

Such a choice provides three advantages:

1. The dead volume ratio is then proportional to $T^{-1}$, and therefore the total dead volume is $$\sum_{i=1}^{6} 2^{-i}.$$

Accordingly, the sum of the dead volumes of the upper sections equals the dead volume of the lowest section.

2. By using this scaling and equation (38), $n_{Tgas}$ is a constant, and hence the gas efficiency of each stage is a constant independent of temperature.

3. The property of metal losses as given by equation (12) is such that the metal losses also become a constant (independent of temperature) when skin depth is not the limitation.

It would be valid to conclude, therefore, that the scaling $L \propto T^{-\frac{1}{2}}$ is an optimal design parameter and so will be used for an optimum design.

Determining $n_{Tgas}$

The linear independence of each regenerator section has already been discussed (see equations 1 and 2). If the final efficiency is to be greater than 50%, the product of the efficiencies of all six sections must be:

$$(1-\text{fractional loss})^6=0.5. \quad (43)$$

The fractional loss is the additional work that must be performed, owing to the losses divided by the heat transferred per stage. Solving equation (43), one obtains a value of 1/9 for the fractional loss. The fractional increase in work due to the two gas losses is $2/n_{Tgas}$. The heat transferred per stage is just $T/\Delta T$ times the work or twice the work. This assumes that the gas losses are dominant so that the fractional loss is $2/n_{Tgas}$ in each section, i.e., $1/n_{Tgas}$ for viscosity and $1/n_{Tgas}$ for thermal lag. Consequently, $$n_{Tgas}=9. \quad (44)$$

Using equation (38) for the lowest temperature section (i.e., 4° to 8° K.) one obtains:

$$fL=260 \text{ cm } s^{-1}, \text{ at } T=5.6° \text{ K}. \quad (45)$$

The choice of f and L is determined by the metal loss. The metal loss condition given by equation (12) favors $L^2$ more than f for large values of $n_{Tgas}$, i.e., for small metal loss. On the other hand, high frequency operation is advantageous from the standpoint of power density of the refrigerator. If an operating frequency of 30 Hz is chosen, then from equation (45), one obtains:

$$L=8.6 \text{ cm, at } T=5.6° \text{ K}. \quad (46)$$

Therefore, from the scaling relations of equation (42), the segment length, L, for any temperature, T, may be expressed as:

$$L=20.4T^{-\frac{1}{2}}\text{cm}. \quad (47)$$

Then, using equation (12) or (41), the inverse metal loss, $n_{TM}$, becomes:

$$n_{TM}=0.5(L^2fNT)^{\frac{1}{2}}=140. \quad (48)$$

This metal loss is 0.033 of the gas loss, $2/n_{Tgas}=0.22$, and therefore the design assumption that the metal losses, longitudinal conduction, and finite heat mass can be made small compared to the gas losses is verified. Later it will be shown that the accessibility of the metal heat mass will require either special anisotropic construction or a material of more favorable properties at low temperatures.

Based on the above assumptions and $n_{Tgas}$=constant, the channel average velocity, $v_c$, from equations (34) and (37) becomes:

$$v_c=(\tfrac{2}{3})v=560T^{-\frac{1}{2}}\text{cm } s^{-1}. \quad (49)$$

Having derived the expressions for $n_{Tgas}$ and $v_c$, only the channel width, w, and the metal thickness, d, need be calculated to complete the regenerator design.

Heat Exchange and Regenerator Channel Width

The heat exchange of the gas with the walls has been defined by the quantity $n_{Tgas}$, which is the number of thermal relaxation lengths of the gas in a regenerator section of length L. Therefore, in a relaxation length, i.e., a distance of $L/n_{Tgas}$, the gas flowing in a channel of width w must approach equilibrium with the two channel walls in a time of $L/(n_{Tgas}v_c)$. In the appendix hereinbelow, the combined problem of frictional or viscous heat production in the moving gas and heat flow to the walls is considered in detail. Here the results of that calculation are approximated by assuming that the flowing gas must be "nearly" in thermal equilibrium with the walls in each relaxation length. With that assumption, the results of the calculation may be described as follows: When the thickness of the half width of the channel, i.e. the distance from the midplane to one of the walls, is $\frac{2}{3}$ of the gas thermal skin depth, i.e., the relaxation time, then the mass average termperature of the gas departs from the wall temperature by 27%. This departure is small enough so that the gas effectively exchanges its heat with the wall $n_{Tgas}$ times in the length of one section. Hence, the thermal diffusion depth in the gas $(\frac{2}{3})$ (w/2) must occur in this time with a thermal diffusivity $D_T$. Laminar flow is assumed, which will be confirmed subsequently herein. Also in the appendix the skin depth of w/3 in the time $L/(n_{Tgas}V_c)$ is separately derived. A diffusion skin depth, $\delta$ may be defined as $\delta=(D_Tt)^{\frac{1}{2}}$, which must equal $\frac{2}{3}$ of the half channel width, w/2, or $$\delta=W/3 \text{ cm}. \quad (50)$$

The thermal diffusivity of helium may be expressed as:

$$D_T = K/(C_p\rho) = 1.55\ (T/T_o)^{3/2}P_o^{-1}\ \text{cm}^2\ s^{-1} \quad (51)$$

-continued $$= 3.3 \times 10^{-4}\, T^{3/2} P_o^{-1}\ \mathrm{cm}^2\, s^{-1},$$

where $P_o$ is the gas pressure in atmospheres and $T_o = 278°$ K. It is noted that if the Prandtl number is 0.67, the kinematic viscosity, $D_\nu$ is equal to 1.0 $\mathrm{cm}^2\, s^{-1}$ at normal temperature and pressure, a well known value.

The time, t, for each element to reach equilibrium with the walls of the channel is:

$$t = L/(n_{Tgas} v_c). \tag{52}$$

If the conditions for $n_{Tgas}$ and L given in equations (44) and (46) are used and equation (49) for $v_c$ is used, then $$t = 4.0 \times 10^{-3} T^{-1}\ s. \tag{53}$$

Accordingly, $$w = 3\, D_T^{\frac{1}{2}} L^{\frac{1}{2}}\, n_{Tgas}^{-\frac{1}{2}}\, v_c^{-\frac{1}{2}}, \text{ or} \tag{54}$$

$$w = 3.5 \times 10^{-3}\, T^{\frac{1}{4}}\, P_o^{-\frac{1}{2}}\ \mathrm{cm}.$$

The Reynolds number is equal to $v(w/2)\rho/\mu$, where $(\rho/\mu) = \frac{2}{3} D_T$. Therefore, the Reynold's number becomes $6.7 \times 10^3\, T^{-\frac{3}{4}}$. Significant departure of the wall stress and heat transport occur only for Rey > 1000, so that for T > 13° K., the assumption of laminar flow is confirmed. Because of turbulent flow, the bottom two sections can be made shorter, and thus the dead volume loss can be reduced. However, the shorter length will increase the skin depth problem of finite accessible heat mass.

Wall Heat Mass

The heat mass of the wall must be such that the heat of the gas is stored with a small thermal lag, $\Delta T/n_{TM}N$, as given by equation (7). As stated before, this thermal lag loss occurs as a result of the temperature mismatch of the gas at the isothermal compression and expansion volumes at the two ends of the regenerator. Therefore, the effective fractional loss per section is $2/n_{Tgas}N$. This assumes perfect temperature match section to section in order that there be no temperature mismatch losses between sections. Because of the non-linear variation of metal and gas properties, this perfect match is unlikely to be achieved in practice, and a more realistic estimate of heat loss is to assume a mismatch per section equal to the thermal lag, i.e., $1/n_{TM}$ per section. This is a factor of 3 larger for a six section regenerator than the ideal case, and therefore this loss may be over estimated. It turns out, however, to be a small loss in the final design.

The two walls of thickness d bounding a channel of width w have a heat mass of 2 $dLC_{metal}$ per unit distance perpendicular to L and w for each regenerator section and store a heat per half cycle of:

$$\text{metal heat per half cycle} = 2\, dLC_{metal} \Delta T n_{TM}^{-1} \text{cal cm}^{-1}. \tag{55}$$

The gas heat, Q, to be stored in a half cycle is:

$$Q = w v_c C_p \rho \Delta T/2f, \text{ or}$$

$$Q = 0.043\, T^{\frac{3}{4}} P_o^{\frac{1}{2}} f^{-1} \text{cal}\ s^{-1} \mathrm{cm}^{-1}. \tag{56}$$

Hence, the metal thickness required may be expressed as:

$$d = (\tfrac{1}{4}) w v_c C_p \rho n_{TM} L^{-1} C^{-1}_{metal} f^{-1}, \text{ or}$$

$$d = 60\, T^{-7/4} P_o^{\frac{1}{2}} f^{-1} n_{TM}\ \mathrm{cm}, \tag{57}$$

where $w = 3.5 \times 10^{-3} T^{\frac{1}{4}} P_o^{-\frac{1}{2}}$ cm, $v_c = 560 T^{\frac{1}{2}}$ cm $s^{-1}$, $L = 20.4 T^{-\frac{1}{2}}$ cm, $C_p \rho = 0.062 P_o T^{-1}$ cal ° K.$^{-1}$cm$^{-3}$, and $C_{metal} = 2.5 \times 10^{-5} T^2$ cal ° K.$^{-1}$cm$^{-3}$ for T < 150° K. and stainless steel. For f = 30 hz, $$d = 2\, T^{-7/4} P_o^{\frac{1}{2}} n_{TM}\ \mathrm{cm}. \tag{58}$$

This metal thickness is so large at low temperatures that $n_{TM}$ must be reduced well below the value of 140 given by equation (48). Otherwise construction becomes difficult, and as will be discussed later, the thermal skin depth in the metal restricts access to the heat mass in any case. If the metal is made thinner, then the conduction loss of equation (9) will be negligible, and the only loss will be the mixing loss at each end of the whole regenerator. Therefore, the thinnest metal that can be chosen corresponds to $n_{TM} = 10$, which assigns 30% loss to the metal and the remainder to the gas dynamics. As such, from equation (58) and $n_{TM} = 10$ the metal thickness becomes:

$$d = 20\, T^{-7/4} P_o^{\frac{1}{2}} \mathrm{cm}, \tag{59}$$

which has the value of 1.0 cm at 5.6° K. and 1 atm. For this metal thickness to be effective, the thermal skin depth in the metal during a cycle must be larger than d. In the second appendix hereinbelow, it is shown that the useful heat mass is ½ the skin depth mass, where the skin depth may be expressed as:

$$\text{skin depth} = [(K/C_{metal})t]^{\frac{1}{2}} \tag{60}$$

where $t = 1/(\pi f)$ and from equation (10) for stainless steel, $$K/C_{metal} = D_T = 8.4\, T^{-1} \mathrm{cm}^2\, s^{-1}. \tag{61}$$

Therefore, $$\text{skin depth} = 1.6\, T^{-\frac{1}{2}} f^{-\frac{1}{2}} \mathrm{cm}, \tag{62}$$

which has the value of 0.126 cm at 30 Hz and 5.6° K. The useful heat mass of the skin depth in stainless steel (half the above) is then much smaller than the above required heat mass by the ratio $0.007T^{5/4}$. If one sets half the skin depth equal to the required metal thickness, one arrives at the condition:

$$T_{min} = 32 P_o^{-2/5} f^{2/5} n_{TM}^{4/5}\ °\mathrm{K.}, \text{ or}$$

$$T_{min} = 50 P_o^{2/5}\ °\mathrm{K.} \text{ at } f = 30 \text{ Hz and } n_{TM} = 10. \tag{63}$$

Accordingly, the minimum temperature for using isotropic stainless steel for the regenerator is 50° K. and is nearly independent of pressure and frequency. Consequently, the few lower temperature sections must be made of either a different material or an anisotropic composite construction, such as banded lead and thin metal channel walls. Then all metal losses become small.

The following is an investigation of whether there exists a material that is better suited to the lower stages and that might have a large enough skin depth but not with too large a thermal conduction loss. Since the heat mass loss for stainless steel is large and the thermal conduction loss is small, it is reasonable to expect that a better compromise exists with a higher conductivity material. The minimum loss conditions can be either finite heat mass or conduction or a compromise of both. The finite heat mass condition for two walls and one half the skin depth heat mass is (skin depth)-(Length)$(C_v)T/2^{\frac{1}{2}}=n_{TM}$(heat to be stored). From equations (46), (56), and (60), the finite heat mass condition becomes:

$$2(K/C_v)^{\frac{1}{2}}(\pi f)^{-\frac{1}{2}}(20.4)T^{-\frac{1}{4}}C_v(T/2)^{\frac{1}{2}}=4.3\times10^{-2}T^{\frac{3}{4}}P_o^{\frac{1}{2}}f^{-1}n_{TM}, \quad (64)$$

from which one may obtain:

$$KC_v=2.8\times10^{-5}T^{\frac{1}{4}}P_o^{\frac{1}{2}}f^{-1}n_{TM}^2, \text{ or}$$

$$n_{TM}=190T^{-\frac{1}{4}}P_o^{-\frac{1}{2}}(fKC_v)^{\frac{1}{2}}. \quad (65)$$

At the lowest temperature, T=5.6° K., and at the highest feasible frequency f=30 Hz, the material property must satisfy the condition:

$$KC_v>2.2\times10-6P_on_{TM}^2 \text{ (finite heat mass).} \quad (66)$$

Conduction Loss Material Property

Provided the metal thickness is no greater than half the skin depth, i.e. optimized for finite heat mass loss, the conduction loss for a two-sided channel gives the following:

$$K\Delta T(\text{skin depth})/(\text{length})=f(\text{heat to be stored})n_{TM}^{-1}, \quad (\delta)$$

$$K(T/2^{\frac{1}{2}})(K/C_v)^{\frac{1}{2}}(\pi f)^{-\frac{1}{2}}/(20.4T^{-\frac{1}{4}})=4.3\times10^{-2}T^{\frac{3}{4}}P_o^{\frac{1}{2}}n_{TM}^{-1}, \quad (68)$$

$$K^3/C_v=4.8T^{-3/2}P_ofn_{TM}^{-2}, \text{ and}$$

$$n_{TM}=2.2T^{-\frac{3}{4}}(P_ofC_v/K^3)^{\frac{1}{2}}. \quad (69)$$

At T=5.6° K. and f=30 Hz $$K^3/C_v<11P_on_{TM}^{-2}. \quad (70)$$

If the losses are made equal for the two material conditions of heat mass and conduction, i.e., $n_{TM\ heat}=n_{TM\ conduction}$, then using (65) and (69) one obtains:

$$K=0.108T^{-\frac{1}{4}}P_o^{\frac{1}{2}}\text{cal °K.}^{-1}\text{cm}^{-1}. \quad (71)$$

This condition is surprisingly independent of $C_v$ and f, and nearly independent of T. However, once this optimum conductivity is given, the losses are dependent upon these same factors. If this optimum conductivity is used, then the inverse loss factor becomes:

$$n_{TM}=62T^{-\frac{3}{8}}p_o^{-\frac{1}{2}}f^{\frac{1}{2}}C_v^{\frac{1}{2}}. \quad (72)$$

If the usual operating conditions of $P_o=1$ atm f=30 Hz and the most difficult low temperature stage, i.e., T=5.6° K., are chosen, then $n_{TM}=180C_v^{\frac{1}{2}}$.

We therefore devise a material with a medium thermal conductivity at 5.6° K. of 0.07 cal $cm^{-2}$°$K.^{-1}s^{-1}$ and a specific heat as large as possible but greater than $10^{-2}$ cal $cm^{-3}$°$K.^{-1}$, which corresponds to $n_{TM}=20$.

Materials Properties

The thermal conductivity of most plastics, glasses, and stainless steel is far too low to meet this condition. On the other hand, pure metals have conductivities which are orders of magnitude too high. It is just fortunate that the presence of alloy elements in small fractions, or even dislocations from cold working reduces the conductivity of pure metals by many orders of magnitude. Hence, it is feasible to make many alloys with the proper thermal conductivity. What is more difficult is to obtain an alloy wtih a high heat capacity and the proper conductivity.

Heat capacity at low temperatures is characterized by the Debye temperature, which in turn characterizes the phonon energy of the highest frequenty modes. Hard materials have high frequencies, a high Debye temperature and a low specific heat. Therefore, soft materials with the inverse properties are desired. Lead, cesium, and bismuth best satisfy those properties and are mutually miscible in alloy form. The alloying of two soft materials generally produces a soft material, like solder. But sometimes trace impurities can harden a metal, and in that instance its low temperature heat capacity will decrease. Lead does not become very hard even with small additions of antimony, which is often added for reasons of machinability. Therefore, lead-bismuth and lead-cesium alloys of roughly 99% lead and 1% of cesium or bismuth are optimum. Such alloys of trace additions of bismuth are given in *Thermophysical Properties of Matter,* Vol. I, "Thermal Conductivity" by Touloukian, Y. S.; Powell, R. W.; Ho, C. Y.; Klemens, P. G.; IFI/Plenum, NY, 1970. These alloys have the specific heat of lead and conductivities in the range of interest. The cost, availability, formability, and inertness of lead are distinct advantages in favor of its use. The alloying of lead in the 1 to 10% range will not change its specific heat significantly. In Table I there are tabulated the properties K and $C_v$ of several materials and their effect upon the cycle loss, $(1/n_{TM})$, due to finite heat mass and thermal conduction at T=5.6K, f=30 Hz, and $P_o=1$ atm. It has been assumed that the material thickness is ½ the thermal skin depth.

It is evident that the lead alloy gives the lowest loss, $(1/n_{TMH}+1/n_{TMK})$, but the standard steel alloy, SAE 1020, also come close to satisfying the requirements at the low temperature limit. However the combined metal loss for the lowest temperature section is 10% for lead and 36% for the steel alloy. Consequently, the lead alloy is preferred.

The heat mass criterion improves at lower frequency while conduction becomes worse. If the lead alloy is parameterized very approximately, one obtains:

$$K=0.028T^{\frac{1}{4}}\text{cal cm}^{-2}s^{-1}\text{°K.}^{-1} \text{ for T<100° K., and}$$

$$K=0.28\text{cal cm}^{-2}\text{ s}^{-1}\text{°K.}^{-1} \text{ for T>100° K.} \quad (73)$$

TABLE I

| Material | K | $C_v$ | heat mass loss ($1/n_{TM}$) from eq. (65) | longitudinal conductivity loss ($1/n_{TM}$) from eq. (69) |
|---|---|---|---|---|
| stainless steel | $6 \times 10^{-4}$ | $7.8 \times 10^{-4}$ | 20 | $1 \times 10^{-6}$ |
| steel SAE 1020s | 0.03 | $8 \times 10^{-4}$ | 0.3 | 0.055 |
| lead | 5 | $1.1 \times 10^{-2}$ | $6.2 \times 10^{-3}$ | 32 |
| pure lead | 0.07 | $1.1 \times 10^{-2}$ | 0.052 | 0.052 |
| alloy few % Bi, Cs 40% Pb 60% Sn | 0.21 | $8 \times 10^{-4}$ | 0.114 | 1.0 |
| copper | 0.9 | $3 \times 10^{-4}$ | 0.090 | 15 |
| electrolytic brass | $6.4 \times 10^{-3}$ | $4 \times 10^{-4}$ | 580 | 0.075 |
| Al | | | | |
| 1100 | 0.14 | $2.2 \times 10^{-4}$ | 0.26 | 1.05 |
| 3003 | 0.03 | $2.2 \times 10^{-4}$ | 0.58 | 0.105 |
| 5052 | 0.013 | $2.2 \times 10^{-4}$ | 0.88 | 0.030 |

Assuming that the specific heat is the same as pure lead, the heat capacity at constant volume, $C_v$, may be expressed as:

$$C_v = 3.6 \times 10^{-4}\, T^{-2} \text{ cal cm}^{-3}\ {}^\circ\text{K.}^{-1} \text{ for } T < 20^\circ \text{ K.}, \quad (74)$$
$$= 3.1 \times 10^{-2}\, T^{\frac{1}{2}} \text{ for } 20^\circ \text{ K.} < T < 100^\circ \text{ K., and}$$
$$= 0.31 \text{ for } 100^\circ \text{ K.} < T < 300^\circ \text{ K.}$$

If this scaling is used in equations (65) and (67) with f=30 Hz and $P_o$=1 atm, one obtains:

$$n_{TM}\text{(heat mass)} = 3.3T \text{ for } T < 20^\circ \text{ K.}, \quad (75)$$
$$= 31T^{\frac{1}{4}} \text{ for } 20^\circ \text{ K.} < T < 100^\circ \text{ K.},$$
$$= 310T^{-\frac{1}{4}} \text{ for } 100^\circ \text{ K.} < T, \text{ and}$$
$$n_{TM}\text{(conduction)} = 49T^{-\frac{1}{2}} \text{ for } T < 20^\circ \text{ K.}, \quad (76)$$
$$= 450T^{-5/4} \text{ for } 20^\circ \text{ K.} < T < 100^\circ \text{ K.},$$
$$= 28T^{-\frac{3}{4}} \text{ for } T < 100^\circ \text{ K.}$$

This scaling gives good efficiency, i.e. $n_{TM\ heat}=n_{TM\ conduction}=19$ at T=5.6° K. Above this temperature the increase in conductivity proportional to $T^{\frac{1}{2}}$, predicted for the lead alloys, rapidly increases the conduction loss so that in the next higher temperature section, i.e., T=11.2° K., $n_{TM\ heat}=37$ and $n_{TM\ conduction}=15$. This gives a combined loss ($1/n_{TMH}+1/n_{TMC}$) of 10%. A better match can be made by decreasing the thickness of the metal so that the finite heat mass loss increases and the thermal conduction loss decreases. If the thickness of the metal is measured in units of the thermal skin depth, $d_m$, and using the design condition that $d_m=\frac{1}{2}$ at 5.6° K., then the optimum value of $d_m$ for the next higher stage is determined by the condition $n_{TM\ heat}$ $d_m=(n_{TM\ conduction})/d_m$.

Since as the metal is made thinner than the skin depth ($d_m<1$), the finite heat mass loss increases, and the thermal conduction loss decreases. Therefore, for each stage, $$d_m = 0.5(n_{TMC}/n_{TNH})^{\frac{1}{2}}, \quad (77)$$

-continued $$= 1.7T^{-\frac{3}{4}} \text{ cm for } T < 100^\circ \text{ K.},$$
$$= 0.15T^{-\frac{1}{4}} \text{ cm for } 100^\circ \text{ K.} < T,$$

and the loss factor becomes the same for both finite heat mass and conduction. The combined loss factor for both effects is:

$$n_{TMcomb} = 15T^{-\frac{1}{4}} \text{ cm for } T < 20^\circ \text{ K.}, \quad (78)$$
$$= 44T^{-\frac{1}{2}} \text{ cm for } 20^\circ \text{ K.} < T < 100^\circ \text{ K.},$$
$$= 24T^{-\frac{1}{2}} \text{ cm for } 100^\circ \text{ K.} < T.$$

The lead alloy thickness is then half the thermal skin depth and therefore becomes:

$$\text{alloy thickness} = \text{half skin depth} = (K/C_v)^{\frac{1}{2}}\,(1/\pi f)^{\frac{1}{2}}, \quad (79)$$
$$= 0.45T^{-\frac{3}{4}} \text{ cm for } 0^\circ \text{ K.} < T < 20^\circ \text{ K.},$$
$$= 0.049 \text{ cm for } 20^\circ \text{ K.} < T < 100^\circ \text{ K.}$$

It is evident that above 20° K., the losses in the special lead alloy become prohibitively large, i.e., at 20° K., the combined value corresponds to $n_{TMcomb}=14$ and a loss of 7%. Above this temperature the losses rapidly become larger. These losses can be limited by changing the alloy composition of each section to decrease the thermal conductivity while approximately maintaining the same specific heat. The optimum thermal conductivity is then used in each stage, and one obtains as the loss factor given in equation (72) with the value of $C_v$ for lead, or $$n_{TMcomb} = 3.3T^{\frac{3}{8}} \text{ for } T < 20^\circ \text{ K.},$$
$$= 30T^{-\frac{1}{8}} \text{ for } 20^\circ \text{ K.} < T < 100^\circ \text{ K.},$$
$$= 95T^{-\frac{3}{8}} \text{ for } 100^\circ \text{ K.} < T < 300^\circ \text{ K.}$$

The half skin depth factor or metal thickness, $d_m=\frac{1}{2}(K/C_v)^{\frac{1}{2}}(1/\pi f)^{\frac{1}{2}}$, becomes:

$$dm=0.9T^{-9/8}\text{cm for T<20° K.},$$
$$dm=0.1T^{-\frac{3}{8}}\text{cm for 20° K.<100° K.} \quad (80)$$

It is apparent that the efficiency of the lead alloy falls off above 100° K. or $(1/n_{TM})>6\%$. It might therefore be more efficient to use stainless steel with a very low conductivity above this temperature, where a simlar analysis for stainless steel gives:

$$K=2.1^{-3}T^{\frac{1}{2}}\text{cal°K.}^{-1}\text{cm}^{-1} \text{ for } 100° \text{ K.}<T, \quad (81)$$

$$C_v=4.7\times10^{-2}T^{\frac{1}{2}}\text{cal°K.}^{-1}\text{cm}^{-3} \text{ for } 100° \text{ K.}<T, \quad (82)$$

$$n_{TM\ heat}=10.3T^{\frac{1}{4}} \text{ for } 100° \text{ K.}<T, \quad (83)$$

$$n_{TM\ cond}=2.7\times10^{4}T^{-5/4} \text{ for } 100° \text{ K.}<T, \text{ and} \quad (84)$$

$$d_m=26T^{-\frac{3}{4}}\text{cm}<1 \text{ for all } T>77° \text{ K.} \quad (85)$$

Therefore, the material is conduction limited and a thickness less than the skin depth will improve the balance. The effective loss becomes:

$$\text{half skin depth}=[(K/C_v)(1/\pi f)]^{178}=0.11\text{cm}, \quad (86)$$

and the combined loss factor for the optimum thickness $d_m\times$(skin depth) becomes:

$$n_{TM\ comb}=213T^{-\frac{1}{2}}, \quad (87)$$

or 6% at 160° K. and 4.4% at 88° K.

Accordingly, the four lower temperature sections are lead alloy and the upper two sections are stainless steel. A regenerator design using lead alloy and stainless steel metal foil for $P_o-1$ atm. helium, f=30 Hz and cooling power=0.2 watts at 4° K. requiring 56 watts input is summarized in TABLE II.

TABLE II

| T (°K) | Length L (cm) | Channel Width w (cm) | $n_{Tgas}/2$ | Material | Metal thickness d (cm) | Combined metal loss $n_{TM}$ | Total $n_T$ | Lateral extent E (cm) | ID (cm) |
|---|---|---|---|---|---|---|---|---|---|
| 5.6 | 8.6 | $5.4\times10^{-3}$ | 4.5 | Pb alloy | 0.12 | 10 | 3.1 | 2.0 | .88 |
| 11.2 | 6.1 | $6.4\times10^{-3}$ | 4.5 | Pb alloy | 0.060 | 15 | 3.5 | 2.4 | .88 |
| 22.4 | 4.3 | $7.6\times10^{-3}$ | 4.5 | Pb alloy | 0.025 | 20 | 3.7 | 2.8 | .94 |
| 44 | 3.04 | $9.1\times10^{-3}$ | 4.5 | Pb alloy | 0.015 | 19 | 3.6 | 3.3 | 1.08 |
| 88 | 2.15 | $11\times10^{-3}$ | 4.5 | s.s | 0.022 | 23 | 3.7 | 4.0 | 1.32 |
| 160 | 1.52 | $13\times10^{-3}$ | 4.5 | s.s | 0.012 | 17 | 3.6 | 4.8 | 1.55 |

The overall efficiency then becomes:

$$(1+\tfrac{1}{2}n_{T1})^{-1}\times(1+\tfrac{1}{2}n_{T2})^{-1}\ldots=45\%, \quad (88)$$

where the factor of 2 is the ratio of the ideal PdV work per stage to the heat transported ($T/\Delta T=2$). This efficiency is low enough such that the second order efficiency effects are pronounced. From equation (2) this will reduce the efficiency to ~25%. In other words the higher order effects become prohibitive leading to the typical exponential loss of most conventional regenerators.

The metal losses contribute roughly 18% of the loss. As such, reducing the metal losses alone will not significantly improve the efficiency. For higher total efficiency, it is necessary to reduce the frequency. The gas losses decrease as f, but the metal losses increase as $f^{-\frac{1}{2}}$. Since they are roughly equal at f=30 Hz, only a small gain can be achieved by using a lower frequency without causing a fundamental change in the metal loss mechanism. Therefore, for some applications it is worthwhile considering an anisotropic construction which can potentially reduce the metal losses to a negligible value.

Segmented Regenerator Design

The largest improvement in efficiency can be obtained by using a segmented channel construction in conjunction with reducing the frequency to increase the gas efficiency. To obtain this anisotropic thermal property and at the same time maintain the aerodynamic advantage of having a narrow, smooth walled channel requires that the walls facing the gas be a thin, low thermal conductivity material backed by bands of high thermal conductivity material spaced with gaps. The bands must have a high heat capacity as well as a high thermal conductivity. Such alternating gaps consisting of thin, low conductivity wall material gives rise to a high impedance to longitudinal heat flow and therefore reduces the conduction loss in the direction of the gas flow. The alternating bands of high conductivity, high heat capacity material that back up the thin wall material provide the heat capacity of the regenerator. The transverse conductivity of the thin wall material offers some thermal impedance to heat flow to the high heat capacity material of the bands. Hence, the walls must have sufficiently high conductivity, large enough area, and be thin enough such that this impedance is not large. Alternatively, the thin wall can be dispensed with entirely by using a solid insulating material in the gaps so that the gap material and the band material present a continuous smooth surface to gas flow. Finally the bands are nearly isothermal because of their high thermal conductivity. Consequently, there must be a sufficient number of bands, $N_B$, such that in a section of length L the temperature drop across each gap, $\Delta T/N_B$, is small enough, and the entropy gain due to the temperature drop across each gap is small.

The gap regions do not contribute to the regenerator function because there is negligible heat mass in the walls of such regions. Consequently, the total gap length in each section contributes to the gas friction and to the dead volume loss without adding to the regenerator function. For that reason, the fractional length of the sum of all the gaps, G/L, should be sufficiently small so that $n_{Tgas}$ is not significantly decreased as a result of the segmented construction. The total number of segments, $N_B$, and the fractional gap length, G/L, do not interact or conflict with any other function. Accordingly, $N_B$ should be large so that the fractional loss resulting from the segmentation is small. The temperature drop across each gap is $\Delta T/N_B$ or $T/2N_B$. The irreversible heat exchange across each gap is $T/2N_B$, and consequently the fractional loss is $\frac{1}{2}N_B$. This occurs $N_B$ times per section. Accordingly, the fractional segmentation loss becomes approximately $\frac{1}{4}N_B$.

If $N_B>10$, then the segmentation loss can be neglected compared to other uncertainties. Similarly, the fractional gap should be small so that the gas loss is not increased. If G/L=10%, $n_{Tgas}$ (friction) decreases by 1/1.1 and can for that reason also be neglected in comparison to other uncertainties. The dead volume will also be increased by 10%, which is likewise a small correction. A design of a segmented thin channel wall regenerator with G/L=10% and $N_B$ large than 10 will now be described. It will be assumed that an appropriate heat mass material for the bands backing up the thin channel walls can be chosen such that the heat mass can be made semi-infinite without a skin depth restriction. This is exemplified in Table I by the heat mass loss for pure lead of 1/150. If the lead were made half a skin depth thick (e.g., ~1 cm at 30 Hz and 5.6° K.), the quantity $n_{TM}$ would have a value of 300. Instead, a practical construction would reduce the thickness to 0.2 cm thick so that $n_{TM}$ is approximately 30, which corresponds to a negligible (3%) heat mass thermal lag loss. Accordingly, a laminated thin metal wall and lead strip construction with a 10% gap is envisaged. The question is what materials and thickness of the walls can be used so that the gap loss and transverse conduction loss are reasonably small. If a solid insulating material is used for the gaps, this problem does not exist.

Longitudinal Loss

The longitudinal conduction loss along the gaps and for two walls of one channel becomes:

$$\text{longitudinal conduction loss} = 2dK\Delta T/(L/10)\text{cal s}^{-1}\text{cm}^{-1}, \quad (89)$$

where d is the wall thickness, K the thermal conductivity, ΔT the temperature drop for each section, and (L/10) the collective gap length.

Transverse Loss

The loss due to the thermal impedance against heat flow to the heat mass of the bands corresponds to an entropy gain from the irreversible temperature drop $T_d$ across the thin metal wall. This loss occurs twice each cycle and corresponds to:

$$\text{transverse loss} = 2(T_d/T)Q\,f/2, \quad (90)$$

where Q is the heat transferred each half cycle from equation (56) for two walls, and the factor of ½ is the cycle average loss. The temperature drop, $T_d$, through the wall becomes:

$$T_d = [(Q\pi f/2)d]/(0.9LK), \quad (91)$$

where $\pi f$ is the effective rate per half cycle and ½ is for 2 walls of effective length $L(1-G/L)=0.9L$. Therefore, $$\text{transverse loss} = (Q^2f^2\pi d)/(1.8\text{ KLT})\text{cal s}^{-1}\text{cm}^{-1}. \quad (92)$$

If these two losses are equated to find the minimum condition, one obtains:

$$K = 0.35Qf/T. \quad (93)$$

Using equation (56) for Q, one obtains:

$$K = 1.5\times10^{-2}T^{-\frac{1}{2}}\text{cal cm}^{-2}\text{°K}^{-1}\,s^{-1}, \quad (94)$$

and the combined inverse fractional loss becomes $$n_{TM} = Qf/[(2Q^2f^2\pi d)/(1.8KLT)] = 0.10L/d = 2.1T^{-\frac{1}{2}}/d. \quad (95)$$

The inverse loss for the longitudinal loss alone becomes:

$$n_{TM\ long} = 0.62T^{-\frac{3}{4}}/Kd. \quad (96)$$

For stainless steel foil, the lowest conductivity high strength material, having a thickness of 0.0025 cm, the inverse longitudinal loss becomes:

$$n_{TM\ long} = 1.2\times10^6\,T^{-7/4} \text{ for } T<100\text{° K, and}$$

$$n_{TM\ long} = 1.2\times10^5 T^{-5/4} \text{ for } 100\text{° K}<T. \quad (97)$$

The transverse losses for stainless steel foil becomes:

$$n_{TM\ trans} = 272T^{-\frac{1}{4}}K/d, \quad (98)$$

and for stainless steel foil having a thickness of 0.0025 cm, the inverse transverse loss becomes:

$$n_{TM\ trans} = 22.5T^{\frac{3}{4}}\ T < 100\text{° K., and} \quad (99)$$

$$= 225T^{\frac{1}{4}} \text{ for } 100\text{° K.} < T.$$

Therefore, the metal losses are negligible, except for the transverse loss at low temperature, e.g., at T=5.6° K. In this case, $n_{TM\ trans}=20$. If brass foil is used, with its 10 times larger conductivity, the metal losses would be negligible.

The design of a segmented regenerator backed up by pure lead bands is given in Table III. Note that the thin wall metal losses are independent of frequency so that low frequency operation can be used to advantage to reduce the gas losses. This also assumes that the back-up material affords a large heat mass.

Heat Mass Loss

The thickness of the back-up heat storage bands of lead will now be calculated. Here the skin depth limit imposes a frequency dependent loss. A typical commercially pure lead will have a lower thermal conductivity than the ultra pure sample considered in Table I. Impurities affect only the low temperature limit. A conservative value for this conductivity is 40% that of pure lead, i.e., $$K = 2\text{ cal cm}^{-1}K^{-1}s^{-1} \text{ for } 5\text{° K.} < T < 10\text{° K.}, \quad (100)$$

$$= 20T^{-1} \text{ for } 10\text{° K.} < T < 100\text{° K., and}$$

$$= 0.2 \text{ for } 100\text{° K.} < T.$$

The heat capacity is the same as for the special lead alloy, as given by equation (74). With these properties the heat capacity loss for commercially pure lead given by equation (65) at $P_o=1$ atm and with a full skin depth becomes:

$$n_{TM\ (heat\ mass)} = 380T^{-\frac{1}{4}}(fKC_v)^{\frac{1}{2}}, \quad (101)$$

$$= 10.2f^{\frac{1}{2}}T^{\frac{3}{4}} \text{ for } T < 10\text{° K.},$$

$$= 32f^{\frac{1}{2}}T^{\frac{1}{4}} \text{ for } 10\text{° K.} < T < 20\text{° K.},$$

$$= 300f^{\frac{1}{2}}T^{-\frac{1}{2}} \text{ for } 20\text{° K.} < T < 100\text{° K.},$$

$$= 95f^{\frac{1}{2}}T^{-\frac{1}{4}} \text{ for } 100\text{° K.} < T, \text{ and}$$

-continued $$\text{skin depth} = (K/C_v)^{\frac{1}{2}} (\pi f)^{-\frac{1}{2}}, \quad (102)$$

$$= 42T^{-1} f^{-\frac{1}{2}} \text{ cm for } T < 10° \text{ K.},$$

$$= 133T^{-3/2} f^{-\frac{1}{2}} \text{ cm for } 10° \text{ K.} < T < 20° \text{ K.},$$

$$= 14.3T^{-\frac{3}{4}} f^{-\frac{1}{2}} \text{ cm for } 10° \text{ K.} < T < 100° \text{ K., and}$$

$$= 0.45 \text{ cm for } 100° \text{ K.} < T.$$

One observes in equation (100) that the finite heat mass loss, even at the lowest temperature of 5.6° K. and reasonably low frequencies of 7.5 to 15 Hz, has an acceptably small value of $1/n_{TM}=7\times10^{-3}$ and can therefore be neglected. Nevertheless, the skin depth as given by equation (102) is large. The skin depth at 15 Hz and 5.6° K. becomes 1.94 cm. This leads to too large a mass of metal with negligible benefit. It is therefore advantageous to choose a thickness of lead less than one skin depth but sufficiently large to result in a loss small compared to the gas loss, e.g., 15%. This leads to a lead thickness at f=15 Hz of:

$$d_m = 5.9 \times 10^{-3}\, T^{\frac{1}{4}}/C_v \text{ cm}, \quad (103)$$

$$= 16.5T^{-7/4} \text{ cm for } T < 20° \text{ K.},$$

$$= 0.19T^{-\frac{1}{4}} \text{ cm for } 20° \text{ K.} < T < 100° \text{K., and}$$

$$= 1.9 \times 10^{-2}\, T^{\frac{1}{4}} \text{ cm for } 100° \text{ K.} < T.$$

Reasonable thicknesses for the three lowest temperatures sections at a frequency of 15 Hz are 0.8 cm for 4° to 8° K.; 0.3 cm for 8° to 16° K.; and 0.1 cm for 16° to 32° K.

A constant thickness of 0.05 cm is used for sections of lead or a good metal conductor operating at temperatures greater than 32° K. For lower frequencies, the thickness from equation (100) with constant $n_{TM}$ scales as $f^{\frac{1}{2}}$. The design of a regenerator with this compromise of lead thickness, foil thickness and for a frequency of 15 Hz is given in Table III. The value of 15 Hz is chosen fabricate the three higher temperature sections. One observes that the foil losses are small (i.e., $n_{Tfoil}$ is large). Therefore, the alternate construction of gaps made of solid insulating material (e.g., glass foam) is not listed in Table III.

Table III summarizes a regenerator design using thin foil wall (0.0025 cm thick) backed up by segmented lead, in which $P_o=1$ atm helium, f=15 Hz, number of bands=20 per section, gap fraction=10%, cooling power=0.4 watts at 4° K. and input power=56 watts. The parameters tabulated in Table III are defined as follows: T is in degrees Kelvin and is the median temperature of the regenerator section. L is the length of each section in cm. w is the channel width in cm. $n_{Tgas}$ is the inverse gas loss chosen to be a constant 9, or 12% loss per stage. Foil material is the material of the lining of the channel walls, if a composite channel wall is used. $n_{Tfoil}$ is the inverse foil loss. Skin depth is the thermal skin depth in cm of the lead or heat capacity material. Thickness is the thickness in cm of the heat capacity material. Band material is the heat capacity material; $n_T$ is the inverse loss of the band material, and $n_{Ttotal}$ is the total inverse loss, including the gas and material losses. E is the largest extent of the channel in cm needed to carry the gas flux for the desired cooling capacity from equation (108). And Diam. is the mean channel diameter, which is equal to $E/\pi$ if the lateral extent is wrapped around in a circular cross section. In the example chosen, in the lowest temperature section the lead thickness is more than the radius for a circular cross section with the given lateral extent E=2.0 cm. The outside of the channel is not restricted so that half the heat capacity lead is not restricted. The inside will be restricted and either a slightly higher loss will occur, or a cryogenic cooler of twice the capacity and hence twice the value of E and twice the diameter will be required. In this case there is no restriction to the thickness of lead inside the channel circumference. It is noted that large capacity, multiple channel regenerators may be constructed in accordance with the present invention by using multiple coaxial tubular members as will be further explained hereinbelow.

TABLE III

| T (°K) | L (cm) | w (cm) | $n_{Tgas}$ | Foil Material | $n_{Tfoil}$ | Skin Depth (cm) | Thickness (cm) | Band Material | $n_T$ | $n_{Ttot}$ | E (cm) | Diam (cm) |
|---|---|---|---|---|---|---|---|---|---|---|---|---|
| 5.6 | 8.6 | $5.4 \times 10^{-3}$ | 9 | brass | 200 | 1.94 | 0.80 | Pb | 60 | 7.5 | 2.0 | 0.64 |
| 11.2 | 6.1 | $6.4 \times 10^{-3}$ | 9 | brass | 200 | 0.92 | 0.30 | Pb | 75 | 7.7 | 2.4 | 0.80 |
| 22.4 | 4.3 | $7.6 \times 10^{-3}$ | 9 | s.s | 220 | 0.32 | 0.10 | Pb | 68 | 7.8 | 2.8 | 0.90 |
| 44 | 3.04 | $9.1 \times 10^{-3}$ | 9 | s.s | 300 | 0.22 | 0.05 | Pb or Cu | 88 | 8.0 | 3.3 | 1.05 |
| 88 | 2.15 | $11 \times 10^{-3}$ | 9 | s.s | 230 | 0.13 | 0.05 | Pb or Cu | 124 | 8.1 | 4.0 | 1.3 |
| 160 | 1.52 | $13 \times 10^{-3}$ | 9 | s.s | 160 | 0.12 | 0.05 | Pb or Cu | 50 | 7.3 | 4.8 | 1.5 |

such that the total gas losses are small enough (~22%) for 6 stages and the capital cost and power cost are comparable. The associated metal losses are then only a modest addition.

As pointed out earlier, the particular advantage of lead is its high heat capacity at low temperatures. The anisotropic thermal property of the regenerator is an advantageous even at high temperatures where other materials can be used. In particular, the construction of the thin, multi-banded regenerator members may be facilitated at higher temperatures by using copper with its higher conductivity and comparable or larger heat capacity than lead for temperatures greater than 50° K. This allows the use of photolithographic masks and etching technology on copper clad stainless steel to The overall efficiency then becomes:

$$(1+\tfrac{1}{2}n_{T1})^{-1}\times(1+\tfrac{1}{2}n_{T2})^{-1}\ldots=70\% \quad (104)$$

The second order effect given by equation (3) will reduce this to about 50%. This is an excellent efficiency for a cryogenic refrigerator. It has been assumed that the losses in the isothermal compressor and expander at each end are small.

The Lateral Extent of Channel (perpendicular to w)

The mass flow through the regenerator is the same for each section so that the cross-sectional area for gas flow, $A_g$, must be such that a constant mass flux is obtained. Since the channel width w is determined, this leads to a channel lateral extent, E, such that $$\pi_g v_c A_g = v_c w E(\rho_o/T) = \text{constant}, \quad (105)$$

where $A_g = wE$, and $\rho_g = \rho_o/T$. The heat pumped per unit open area of the regenerator is given by:

$$Q = v_c P_o(T/\Delta T)(\ln C_R)/2 = 0.69 v_c P_o = 39T^{\frac{1}{2}} \text{watts cm}^{-2} \quad (106)$$

Using equation (49) for $v_c$ and letting $P_o = 1$ atm and $C_R = 2$ in equation (105), one obtains:

$$A_g = (\text{Power})/Q = 0.26T^{-\frac{1}{2}}(\text{Power}) \text{ cm}^2. \quad (107)$$

The lateral extent of the regenerator then becomes:

$$E = A_g/w = 7.3T^{-\frac{3}{2}}(\text{Power}) \text{ cm}, \quad (108)$$

with w from equation (54). This gives the lateral extent, E, for a given T and power. If we choose a given power at T=5.6° K., then the conservation of mass and equation (93) gives for the upper sections $$E = 2.0(T/5.6)^{\frac{1}{4}}(\text{Power}_o) \text{ cm}, \quad (109)$$

where T is the mean temperature of each section and $(\text{Power}_o)$ is the power at the low temperature end (4° K.). The cross-sectional area, $A_g$, of the regenerator then becomes:

$$A_g = E(W + 2d_{wall} + 2d_{seg}) \text{ cm}^2, \quad (110)$$

where $d_{wall}$ is the thickness of either the special lead alloy of Table II or the thin foil of Table III, $d_{seg}$ is the thickness of the lead or other heat capacity material of Table III and $\text{power}_o$ is 1 watt at 4° K.

The Displaced Volume

The displaced volume, vol, in each of these regenerators becomes:

$$\text{vol} = A_g v_c/2f = 7.3/f \text{ cm}^3\text{watt}^{-1}. \quad (111)$$

For 1 watt at 4° K., the displaced volume because 0.24 $cm^3$ at 30 Hz for the lead alloy regenerator of Table II and twice that, i.e., 0.48 $cm^3$, at 15 Hz for the segmented lead regenerator of Table III. At the room temperature end the displaced volume for the two cases are 300/4 larger, or 18 $cm^3$ and 36 $cm^3$, respectively.

Bellows Compression and Expansion Volume

The compression and expansion volumes should be isothermal. Otherwise, the heat of adiabatic compression is lost each cycle at each end. For a comparison ratio of 2:1, this lost work is given by $2(2^{\gamma-1}-1)$, which comes out to a 64% loss or a 36% work efficiency. This is a large additional penalty in efficiency and is a larger source of loss than the regenerator. Therefore, there is a major advantage in using isothermal compression and expansion volumes. The isothermal bellow designed for heat pumps are ideal for this purpose. At low temperatures the fatigue life of metals is extended, and the thermal conductivity of pure metals is increased. Therefore, metal bellows of the aforementioned special thermodynamics design become ideally suited for both the compression as well as the expansion volumes.

The low temperature bellows will be different from the high temperature one, because the volume of the former is smaller and the diffusivity of the working fluid (helium) decreases at low temperature as $T^{\frac{1}{2}}$. Accordingly, the stroke and therefore the convolution clearance must be smaller by $(T_1/T_0)^{\frac{1}{2}} = 0.12$ The volume is smaller by $(T_1/T_0) = 0.013$. This means that if a given thermodynamics bellows has been designed to work effectively at room temperature with, for example, 5% loss at 30 Hz and 1 atmosphere pressure of helium, then the corresponding bellows of the same size and area convolution to be used for the expansion volume must have $(T_1/T_0)^{\frac{1}{2}} = 1/8.7$ fewer convolutions and a stroke that is smaller by $T_1/T_0 = 1/75$. However, a smaller diameter low temperature bellows may be used, since the volume is reduced by $T_1/T_o = 1/75$ and the dimensions are reduced by $(T_1/T_0)^{\frac{1}{3}} = 0.237$. Hence, for the same number of convolutions the stroke may be smaller by 0.237 per convolution. As a consequence, the thermalization time of the working gas with the walls of the bellows, which is proportional to $(\text{stroke})^2/(\text{diffusion coefficient}) = (T_1/T_o)^{\frac{2}{3}}/(T_1/T_o)^{\frac{1}{2}} = 0.5$, is a factor of two shorter in a smaller low temperature bellows. Therefore, a smaller size low temperature expansion bellows is a better isothermal volume than the room temperature compression bellows, owing to the shorter thermalization time in the smaller bellows. Since the stroke of the low temperature expansion bellows may be smaller than the room temperature compression bellows, the whole regenerator structure can be used as the drive rod for the expansion bellows. This allows the opposite end of the expansion bellows to be fixed for thermal coupling to a refrigerator load.

Summary

Two cryogenic regenerators have been disclosed where the gas losses, viscosity, thermal conductivity, and volume have been considered separately from the storage heat mass losses of conductivity and heat capacity in order to minimize the total loss. The longitudinal length in the direction of the gas flow has been divided into sections, where the temperature change of each section is half the absolute temperature. The gas flows in each section in a parallel smooth wall channel, and the gas velocity, channel width, and segmented length are optimized to minimize friction, thermal lag loss, and cycle volume loss. The wall properties are then optimized in two regenerator designs, one with a special lead alloy of lower conductivity than pure lead, and a second regenerator of segmented lead or copper bands that back up a smooth, thin brass or stainless steel wall. The segmented banded design results in a better efficiency, 50%, at a lower frequency of 15 Hz. The isotropic construction of special lead alloy results in about 25% efficiency at 30 Hz. Special isothermal bellows must be used for the compression and expansion volumes in order to maintain these overall differences.

APPENDIX I

The Compounding of Losses

Let $\dot{S}(T)$ be the rate at which the refrigerator pumps entropy past temperature T, i.e. $\dot{S} = d/dt\, S(T)$. The the flow of heat past T is $$\dot{Q}(T) = T\dot{S}, \quad (112)$$

and the work for a Carnot refrigerator to pump the entropy from T to (T+dT) is $$\dot{W}_c(T)dT=\dot{Q}(T+dT)-\dot{Q}(T)=\dot{S}dT. \quad (113)$$

Suppose the actual work is $\dot{W}(T)dt=m\dot{W}_c(t)dT=m\dot{S}dT$. Then if the work not required to pump the heat is locally deposited (i.e., as wall friction), it leads to an increase in entropy flow rate $d\dot{S}=(m-1)\dot{S}dT$. Since $\dot{W}/\dot{W}_c=m$, the efficiency relative to Carnot locally (i.e. at T) is $m^{-1}$. The integration of these losses gives:

$$T\,d\dot{S} = (m-1)\dot{S}d\,T, \text{ which becomes:} \quad (114)$$

$$\ln(\dot{S}/\dot{S}_o) = \int_o^T [(m-1)dT/T],$$

where $S_o$ is the entropy pumped from the cold reservoir at $T_o$. Then $$\dot{S} = \dot{S}_o \exp\left[\int_{T_o}^{T} \{(m-1)/T\}\,dt\right]. \quad (115)$$

Therefore, the integral of work performed is $$\dot{W} = \dot{W}(T)\,dT = \int_{T_o}^{T_1} m\,\dot{S}\,dT \quad (116)$$

$$= \dot{S}_o \int_{T_o}^{T_1} m \exp\left[\int_{T_o}^{T} (m-1)\,dt/T\right] dt.$$

Let m=1, then $S=S_o$ and $$\dot{W}=\dot{S}_o(T_1-T_o)=\{(T_1-T_o)/T_o\}\dot{Q}_o=\dot{W}_c, \quad (117)$$

as expected where $W_c$ is the Carnot work. Let m=constant not equal to 1, then $$\dot{S}=\dot{S}_o \exp[(\ln T-\ln T_o)(m-1)]=\dot{S}_o(T/T_o)^{(m-1)}. \quad (118)$$

Therefore, $$\dot{W}=m\dot{S}_o\int(T/T_o)^{(m-1)}dT=\dot{S}_o(T_1{}^m/T_o{}^{(m-1)}-T_o), \quad (119)$$

and the desired total efficiency becomes:

$$Eff = W/\dot{W}_c \quad (120)$$

$$= (T_1{}^m - T_o{}^m)/([T_1 - T_o][T_o^{(m-1)}])$$

$$= (T_o/[T_1 - T_o][(T_1/T_o]^m - 1).$$

If this expression is evaluated for a temperature ratio of 300° K./4° K., the following Table is obtained, in which $T_1/T_o=x=75$ and $W/W_c=(x^m-1)/x-1)$

| m | $\dot{W}/\dot{W}_c$ (x = 75) | $\dot{W}/\dot{W}_c$ (x = 2) |
|---|---|---|
| 1.1 | 1.547 | 1.144 |
| 1.2 | 2.39 | 1.30 |
| 1.5 | 8.76 | 1.83 |
| 2.0 | 76.0 | 3.00 |
| 1.01 | 1.045 | |
| 1 + E | 1 + 4.38 E | |
| infinite | $x^{(m-1)}$ | |

For m approaching 1, one can make the approximation that $$x^m = x\,x^{(m-1)} = x^{(m-1)\ln x} = x(1 + [m-1]\ln x) \quad (121)$$

$$(x^m - 1)/(x-1) = (x - 1 + [m-1]^x \ln x)/(x-1)$$

$$= 1 + (m-1)(x/[x-1]\ln x),$$

which is valid if $(m-1)\ln x << 1$ and $(m-1) << 0.22$. Then, ln 75=4.32 and 75/74 ln 75=4.38. In other words, the penalty for an inefficiency of E in each stage is 4.38 times greater than would be the case where it is assumed that the total efficiency of the regenerator is the simple product of the efficiencies of the individual sections.

APPENDIX II

Explanation of Thermal Exchange Length in Channel Flow

A comparison is needed of the thermal exchange length aproximation of a channel regenerator heat transfer to a steady state solution.

The thermal exchange length $\Delta z$ is the distance the gas will move in the channel parallel to the walls in the z direction in the time required for thermal diffusion in the x direction to reach approximate equilibrium with the walls. The direction perpendicular to the wall is x. The velocity used to calculate the length, $<v>$, is a velocity in the x direction averaged across the channel. The time for diffusive equilibrium to occur from the usual skin depth argument is calculated as follows: The diffusion depth, d, may be expressed as $$d=(Dt)^{\frac{1}{2}}, \quad (122)$$

where D is the diffusivity which is equal to $K/C_p\rho$, K is the thermal conductivity, $C_p$ is the heat capacity of the gas at constant pressure and $\rho$ is the density of the gas.

For a channel width w and a half-width w/2, an average depth of heat diffusion that constitutes approximate equilibrium has been estimated as $$d=\tfrac{2}{3}(w/2). \quad (123)$$

Confirming this estimate is the purpose of this appendix.

Substituting the diffusion depth given by equation (122) into equation (123) and solving for t, one obtains $$t=w^2/(9D). \quad (124)$$

The thermal exchange length, $\Delta z$, is the distance the fluid moves in the z direction in a time t, i.e., $\Delta z=t<v>$. The motivation for introducing the thermal exchange length $\Delta z$ is the following: If the temperature relaxes $n_T$ times in a length L, the temperature difference or departure from equilibrium is $\Delta T/n_T$ where $\Delta T$ is the temperature difference over the length of the regenerator. Roughly $\frac{1}{2}$ of this maximum departure difference is irreversible loss each cycle. This is because the departure difference oscillates between positive and negative values over a cycle and is thus averaged. Consequently, the regenerator loss per cycle due to the departure difference will be $\Delta T/2n_T$. This can be compared to ideal channel flow or Poiseuille flow.

Laminar flow in a uniform width channel experiences a shear stress that balances the force per unit extent ("extent" is measured in the y direction perpendicular to x and z). The pressure gradient in the z direction produces this force. This pressure gradient is independent of x, i.e., it is parallel to the channel walls. By symmetry the shear stress in the midplane of fluid must be zero, and at each wall it becomes maximum. Therefore, the fluid shear stress will be proportional to the integral in x of the pressure gradient from the midplane, where x is measured as the axial distance from the midplane. Accordingly, one can write $$\mu dv/dx = \int_0^x (dP/dz)\, dx = P'\, x \text{ and} \tag{125}$$

$$v = (v_{max}/[w^2/8])([w^2/8] - [x^2/2]), \tag{126}$$

where $v_{max}=P'w^2/8\mu$, $\mu$=viscosity and $P'=dP/dz$. Therefore, the velocity is quadratic for $v=v_{max}$ at the midplane to $v=0$ at the wall, and $\langle v\rangle=\frac{2}{3}v_{max}$.

The number of exchange lengths in a channel of length L and maximum velocity $v_{max}$ becomes:

$$n_T=1/(\langle v\rangle t)=(27/2)(DL)/w^2 v_{max})=(27/2)(K/C_p\rho)1/(w^2 v_{max}). \tag{127}$$

The velocity distribution has already been described as quadratic from $v_{max}$ at the mid-plane to $v=0$ at the walls. Since the flow is non-divergent at steady state, the heat flux convected into any layer must be balanced by conduction to the walls. Therefore, $$K\,(dT/dx) = -\,C_p\rho \int_0^x v T_z\, dx. \tag{128}$$

Here the convected flux is $C_v\rho T_z\, v$, where $T_z$ is the temperature gradient in the z direction ($\Delta T/L$). It is assumed that $T_z$ is independent of x because $(dT/dx)>>(dT/dz)$ and $L/n_T>>w/2$. Accordingly, $$dT/dx=-(C_p\rho/K)T_z[v_{max}/(w^2/8)][(w^2/8)x-(x^3/6)], \tag{129}$$

$$T_{max}-T_w=(C_p\rho/K)T_z[v_{max}/(w^2/8)][(w^2/8)(x^2/2)-(x^4/24)], \tag{130}$$

where $T_w$ is the temperature of the channel wall. Then the temperature at the midplane, $T_{max}$, becomes:

$$T_{max}=5/12(C_p\rho/K)T_z v_{max}(w/2)^2+T_w \tag{131}$$

But the temperature departure difference at the end of the regenerator will be $\langle Tv\rangle/\langle v\rangle=5/7(T_{max}-T_w)$ by evaluating equations (126) and (130). The departure difference factor $1/n_T$ then becomes:

$$n_T=\Delta T/[(68/105)T_{max}-T_w], \tag{132}$$

so that $$n_T=L(K/C_p\rho)(336/25)/(w^2 v_{max}).$$

$$n_T=14.8L(K/C_p\rho)/(w^2 v_{max}). \tag{133}$$

This is close to that derived by thermal relaxation length analysis as given by equation (127), where the factor is 13.5. Both derivations used several approximations.

APPENDIX III

Cyclic Heat Energy Loss

When heat is conducted into or out of a medium with finite conductivity, there is an irreversible entropy gain depending upon the thermal diffusivity and the time of transfer. Since the objective of a regenerator is to store heat reversibly and cyclically, this entropy gain is an effective loss to the system. In refrigeration this leads to an inefficiency. This inefficiency will be evaluated as a ratio of (irreversible heat)/(heat stored) per cycle. The irreversible heat is just the (entropy gain)/T, where T is the absolute temperature.

Let K=thermal conductivity, $C_v$=thermal heat capacity per unit volume and $D=K/C_v$=thermal diffusivity. Let the average local temperature be T, and the oscillating temperature T' be $$T'=T+\theta,\ \theta=\theta_o e^{i(kx-\omega)}, \tag{134}$$

The heat equation gives:

$$\frac{\partial T}{\partial t} = D\frac{\partial^2 T}{\partial x^2} \text{ and} \tag{135}$$

$$\frac{\partial \theta}{\partial t} = D\frac{\partial^2 \theta}{\partial x^2}. \tag{136}$$

Substituting T' and $\theta$ given by equation (134) into equations (135) and (136), one obtains:

$$-i\omega\theta = Dk^2\theta \text{ and} \tag{137}$$

$$k = \sqrt{\frac{i\omega}{D}} = \frac{1+i}{\sqrt{2}}\sqrt{\omega/D} = \frac{1+i}{\delta}, \tag{138}$$

where the thermal skin depth $\delta$ is defined as $$\delta = \sqrt{2D/\omega} = \sqrt{D/\pi f} \tag{139}$$

One must now choose the physically appropriate solution. It is known that the temperature fluctuation must decay as one goes far into the material, i.e., as $x\rightarrow\infty$. Therefore, $$\int \theta dx = -\frac{1}{ik}\theta_o e^{-i\omega t} = \frac{-\delta}{\pm i(1+i)}\theta_o e^{-i\omega t} = -\frac{(i+1)\delta}{\pm 2}\theta_o e^{-i\omega t}. \tag{140}$$

When $$x\rightarrow\infty,\ e^{ikx}\rightarrow 0 \text{ so } \mathrm{Im}\,k>0. \tag{141}$$

Therefore, the positive root must be used. As a result, $$Re \int_0^\infty \theta dx = \delta\theta_o e^{i\omega t} \tag{142}$$

The entropy fluctuation may now calculated as $$\partial S = \int_0^\infty dx \int_0^{2\pi/\omega} dt\, \frac{C_v \partial\theta/\partial t}{T'} \tag{143}$$

-continued $$= \int_0^\infty dx \int_0^{2\pi/\omega} dt \frac{C_v}{T}(1-\theta/T)(-i\omega\theta)$$

$$= \frac{i\omega C_v}{T^2} \int_0^\infty dx \int_0^{2\pi/\omega} dt\,(Re\theta)^2.$$

But substituting for k in the definition of $\theta$ in equation (134) gives:

$$\theta = \theta_o e^{(ix/\delta - i\omega t)} e^{-x/\delta} \text{ and} \tag{144}$$

$$Re\theta = \theta_o \cos(x/\delta - \omega t) e^{-x/\delta}. \tag{145}$$

To check the reasonableness of our solution, physically, it is known that the entropy loss or gain at x=0 must be zero. That is:

$$\underset{\text{cycle}}{\frac{d\theta}{T+\theta}} = \ln(T+\theta)_{cycle} = 0 \tag{146}$$

For the solution at x=0, one obtains:

$$dQ = K\frac{\partial\theta}{\partial x} = K\theta_o \frac{d}{dx}\left[\cos\left(\frac{x}{\delta} - \omega t\right) e^{-x/\delta}\right]. \tag{147}$$

Therefore, $$dS = \frac{dQ}{T} = K\frac{\theta_o^2}{T^2}\cos\left(\frac{x}{\delta} - \omega t\right)^{-x/\delta} = \frac{d}{dx}\left[\cos\left(\frac{x}{\delta} - \omega t\right) e^{-x/\delta}\right]. \tag{148}$$

Then the entropy integrated over a cycle becomes:

$$\underset{\text{cycle}}{dS} = \underset{\text{cycle}}{\cos\sin} = 0, \tag{149}$$

Since d cos x/dx→cos x sin x. In addition, the solution for S has the appropriate value at x=0. If one then integrates S as given by equation (148) over time for x≠0, then one obtains:

$$\Delta S = K\left(\frac{\theta_o^2}{T^2}\right)\left(\frac{1}{\delta}\right)\frac{t}{2}. \tag{150}$$

For one cycle $t=2\pi/\omega$. In this time the useful energy exchange from equation (139) is $$\Delta E = C_v Re \int_{\pi/2}^{3\pi/2} \theta dx = C_v\theta_o\,\delta = 2C_v\theta_o\delta. \tag{151}$$

The irreversible energy loss is $$T'\Delta S \simeq T\Delta S, \tag{152}$$

and the useful energy exchange is ΔE. Therefore, the efficiency, eff, or fractional loss becomes:

$$eff = \frac{T\Delta S}{\Delta E} = \left(\frac{D}{\delta^2}\right)\frac{\pi}{\omega}\left(\frac{\theta_o}{T}\right) = \frac{\theta_o}{T}. \tag{153}$$

Since the fluctuating temperature at the boundary is $\pm\theta_o$ during a cycle, the fractional loss is just twice the fractional temperature change divided by the temperature. As the heat storage layer thickness, d, is made thinner than the skin depth, δ, a similar analysis shows that the entropy loss decreases as $(d/\delta)^3$, and the useful energy stored decreases as d/δ. Hence, one obtains as improvement $$\tfrac{1}{3}(d/\delta)^2. \tag{154}$$

This is such a rapid improvement that a useful thickness for a regenerator material is limited to ½ the normal skin depth, in which case the entropy loss due to the heat storage entropy loss in and out will be small compared to the gas loss from the same effect.

DESCRIPTION OF EMBODIMENTS

Referring now to FIG. 1, there is shown a Stirling cycle refrigerator 100 according to one embodiment of the present invention. The refrigerator 100 includes a variable-volume compression chamber 1, a variable-volume expansion chamber 2, each containing helium at a pressure of approximately one atmosphere, and a regenerator 12 interconnecting the two chambers 1 and 2 for displacing the helium gas therebetween. Advantageously, the compression and expansion chambers 1 and 2 each comprise an isothermal bellows, as described in U.S. Pat. No. 4,490,974.

During operation of the refrigerator, the gas in the expansion bellows 2 is at a cryogenic temperature $T_2$ (e.g., 4° K.). Therefore, the expansion bellows 2 and the regenerator 12 are enclosed within a vacuum vessel 13 to provide thermal insulation for the low temperature portions of the refrigerator 100. The expansion bellows 2 terminates in an end plate 15, which is held stationary with respect to the vacuum vessel 13 by an insulating support member 17. A bore 18 extending through the end wall of the vacuum vessel 13 and the insulating support member 17 permits a refrigerator load 16, such as an infrared sensor, to be mounted in thermal contact with the end plate 15. The load 16 receives the useful work of the refrigerator 100. The end plate 15, the expansion chamber 2 and the colder sections of the regenerator 12 are surrounded by "super" insulation 19 (a multi-layer sandwich of aluminum coated mylar and textile mesh) to reduce radiation loss. The compression bellows 1 operates at ambient temperature $T_1$ (e.g., 300° K.) and is therefore situated outside of the vacuum vessel 13.

The compression and expansion bellows 1 and 2 are driven by a conventional eccentric drive 3 in harmonic quadrature, i.e., 90° out of phase with respect to each other. The eccentric drive 3 comprises a shaft 21 having two eccentrics 5 and 7 for interacting with cross heads 4 and 6, respectively. The shaft 21 is coupled to a motor (not shown) which rotates the eccentrics 5 and 7. Interaction of the rotating eccentric 5 with the cross head 4 produces a relatively long compression stroke $S_1$ for driving the compression bellows 1. Interaction of the rotating eccentric 7 with the cross head 6 produces a relatively short stroke S2 for driving the expansion bellows through the rods 8, the vacuum displacement head 9 and the regenerator 12. In this manner, the working gas is compressed in the compression bellows 1 by a relatively long stroke $S_1$ and displaced through the regenerator 12 to the expansion bellows 2, which is expanded by a smaller stroke $S_2$. Thereafter, the working gas is displaced back through the regenerator 12 to the compression bellows 1 where the cycle repeats.

Additional bellows 10 and 11 are provided to permit movement of the regenerator 12 in the vacuum enclosure 13. The bellows 10 and 11 are passive in the sense that they do not substantially affect the cycle work, since bellows 10 does not contain working gas and the stroke of bellows 11 ($S_2$) is small compared to that of the compression bellows 1 ($S_1$). The bellows 1, 2 and 11 are each provided with a cylindrical puck 14 attached to the moving head of the bellows for making the volume of the bellows nearly zero at the end of its compression stroke. The stationary parts of the refrigerator 100 are illustrated as being attached to a base plate 20.

The displacement volumes $V_1$ and $V_2$ of the compression and expansion bellows 1 and 2, respectively, are advantageously designed such that $V_1/V_2=T_1/T_2$, where $T_1$ and $T_2$ are expressed in degrees Kelvin. The stroke ratio $S_1/S_2$ of the bellows 1 and 2 can be any value from $T_1/T_2$ to $(T_1/T_2)^{\frac{1}{2}}$. At the latter limit the cross-sectional area of the expansion bellows 2 must be smaller than that of the compression bellows by a factor of $(T_1/T_2)^{\frac{1}{2}}$.

When operation of the refrigerator 100 is initially started with the cold end at room temperature, the pressure of the working gas is higher than the final operating pressure by the ratio of the dead volume to the displacement volume of the refrigerator at room temperature. As the temperature of the gas at the cold end of the refrigerator 100 falls, some of the gas will remain at the cold end after each stroke, i.e., the dead volume of each section of the regenerator 12 is proportional to 1/T. Therefore, as the cold end reaches its operating temperature, the mean gas pressure in the refrigerator 100 will fall by a factor of 1.5 to 2, depending upon the details of the construction of the regenerator 12 and the bellows 1, 2 and 11. The decrease in gas pressure as a function of cooling can be helpful for starting the refrigerator 100, since it allows for more refrigerative work to be performed during startup and provides a lower gas pressure when operating temperature is reached. However, if the drive motor (not shown) used is incapable of providing the extra work required during startup, the gas pressure can be maintained at a constant value from startup to low temperature operation by including a gas reservoir in the refrigerator.

Figure 2:
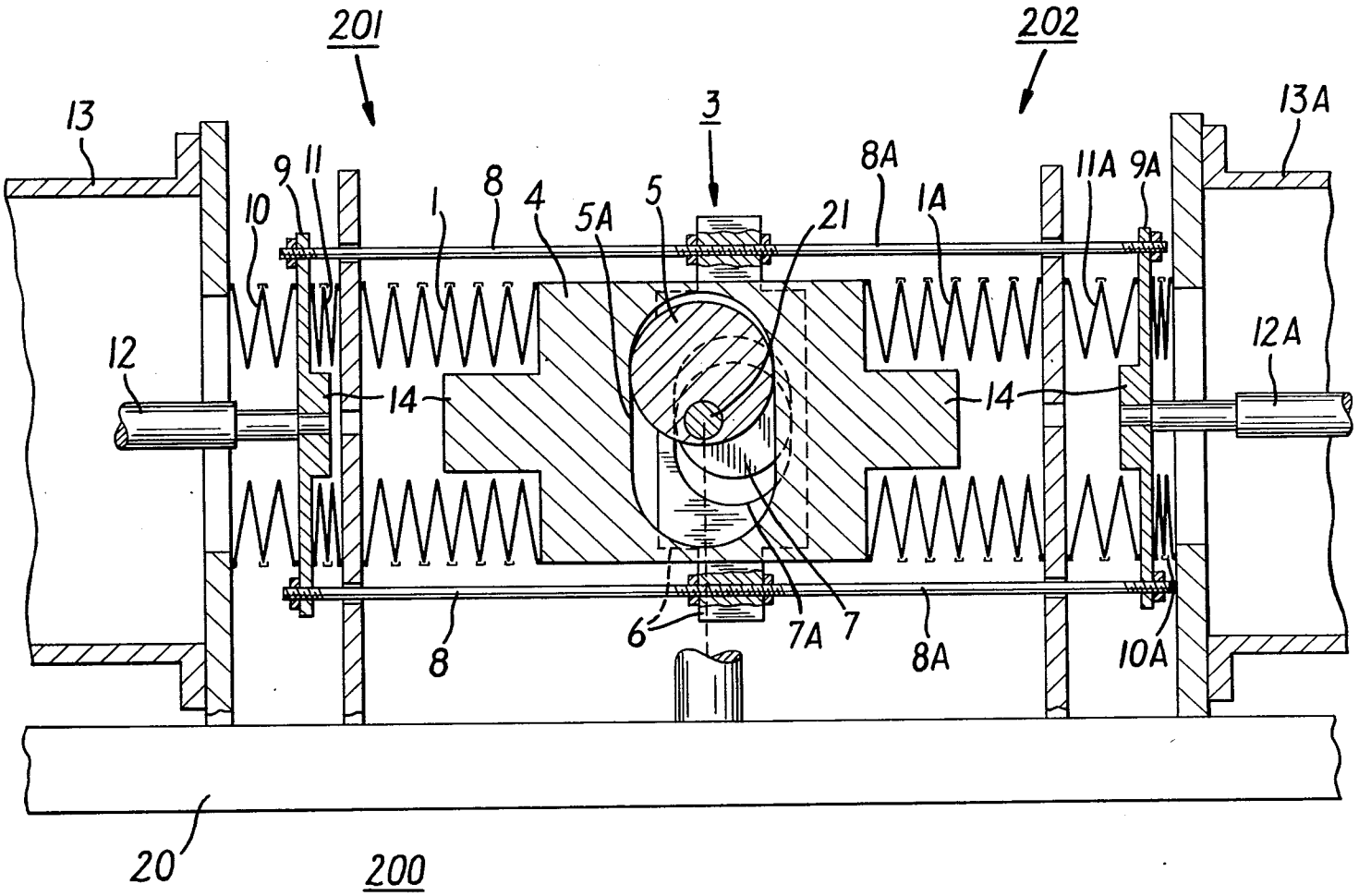
FIG. 2 is an enlarged sectional view showing particularly the eccentric drive for two Stirling cycle refrigerators arranged in a double-ended configuration, the view being along a direction parallel to the shaft of the drive.

Turning now to FIG. 2 there is shown a sectional view showing particularly the eccentric drive 3 of a Stirling cycle machine 200, in which two refrigerators 201 and 202, similar to that illustrated in FIG. 1, are driven by the same eccentric drive 3 in a double-ended configuration. In FIG. 2, only the eccentric drive 3, the compression bellows 1 and 1A, the passive bellows 10 and 10A, 11 and 11A, and portions of the regenerators 12 and 12A and the vacuum vessels 13 and 13A of the refrigerators 201 and 202 are depicted. The omitted portions of each refrigerators 201 and 202 are identical to corresponding portions of the refrigerator 100 illustrated in FIG. 1.

The compression bellows 1 and 1A support the crosshead 4 against lateral motion and allow a double-balanced drive with reduced vibration. The eccentric drive 3 includes a motor driven shaft 21 having two eccentrics 5 and 7 mounted 90° apart. In the depiction of FIG. 2, the eccentric drive 3 is viewed from the end of the shaft 21, and the eccentric 5 and the compression bellows 1 and 1A and the crosshead 4 are shown at top dead center, i.e., the crosshead 4 is centered with respect to the compression bellows 1 and 1A. On the other hand, the eccentric 7 is shown displaced to the right such that the bellows 10A and 11 are compressed and the bellows 10 and 11A are extended. As in the refrigerator 100 of FIG. 1, the bellows 10 and 11 and the bellows 10A and 11A are used to allow axial motion of the regenerators 12 and 12A in their respective vacuum vessels 13 and 13A. The cross-heads 4 and 6 have the cut-outs 5A and 7A, respectively, which are sized and shaped to allow the crossheads 4 and 6 to be laterally displaced by the eccentrics 5 and 7 in purely axial reciprocating motion.

Each of the bellows 1, 1A, 11 and 11A, which contains working gas, is provided with a cylindrical puck 14 to allow the bellows to displace near zero volume at maximum compression.

The lateral motion of the crosshead 6 is transmitted through the rods 8 and 8A to the vacuum displacement heads 9 and 9A, which in turn transmits the lateral motion to the expansion bellows (not shown) of the refrigerators 201 and 202.

Figure 3:
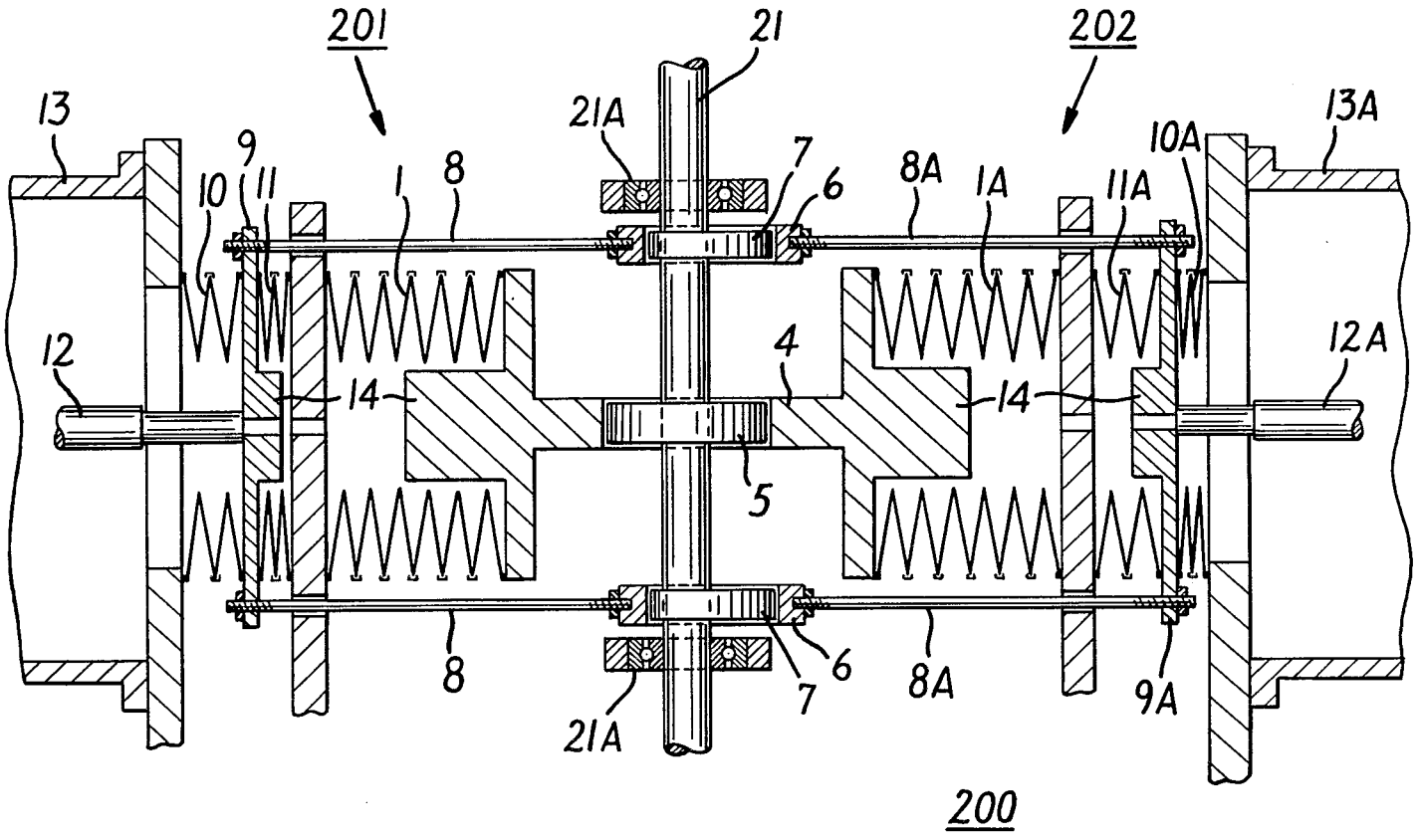
FIG. 3 is another enlarged sectional view showing particularly the eccentric drive of FIG. 2, as viewed from a direction transverse to the shaft of the drive.

In FIG. 3, there is shown an alternate sectional view particularly showing the eccentric drives of the double-ended refrigerator configuration 200 of FIG. 2 from a direction perpendicular to the drive shaft 21. From the depiction it may be seen that the eccentric 7 and the crosshead 6 driven thereby are constructed in two parts, one at each side of the crosshead 4, to provide a balanced drive of the vacuum displacement heads 9 and 9A.

Figure 4:
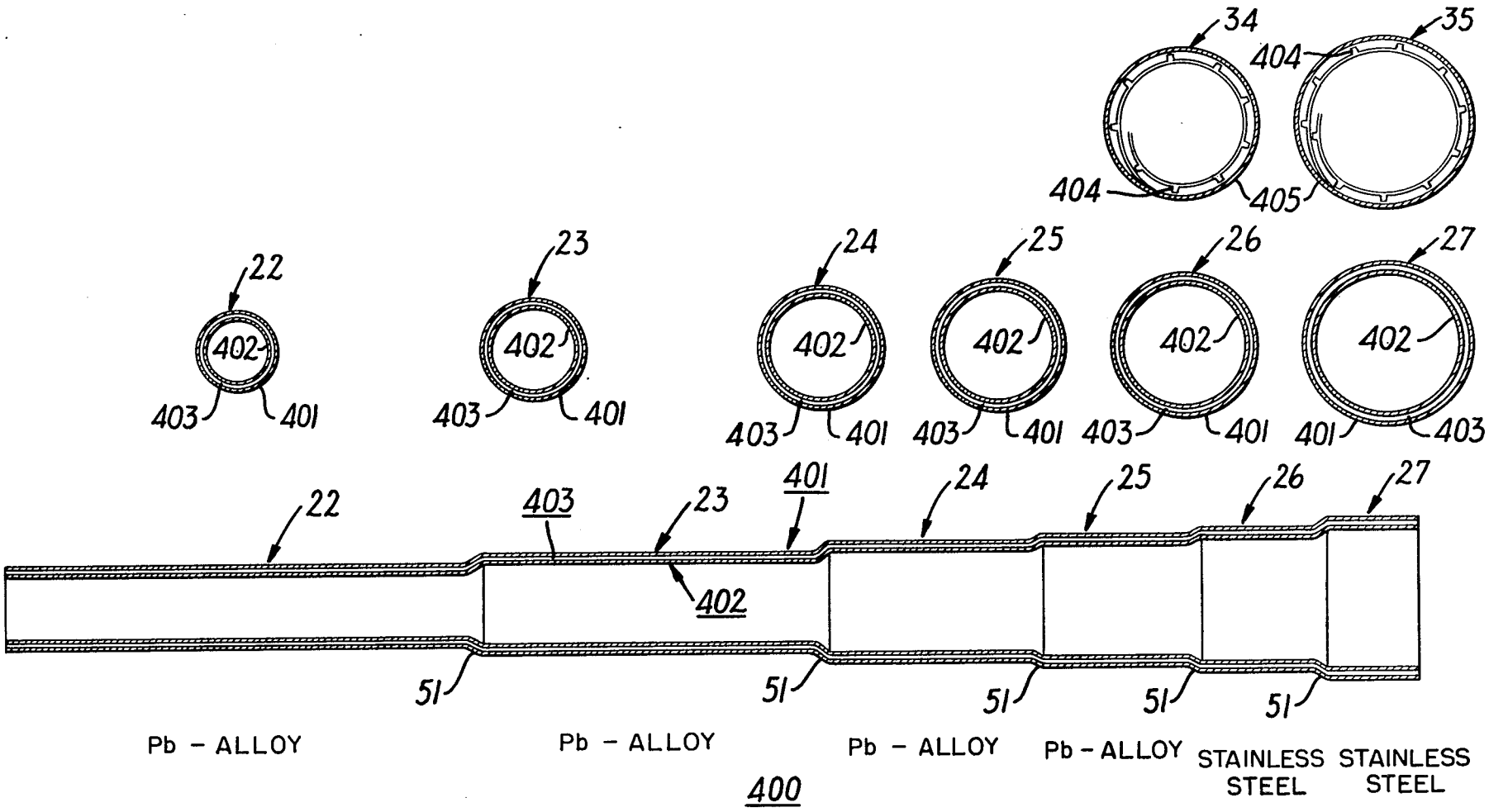
FIG. 4 shows a longitudinal sectional view of a regenerator for a Stirling cycle machine according to one embodiment of the present invention, and transverse sectional views of each of the sections of the regenerator, including alternative constructions for the two highest temperature sections.

Referring now to FIG. 4, there is shown a longitudinal sectional view of a regenerator 400 according to one embodiment of the present invention. The regenerator 400 comprises an outer stepwise-tapered tubular member 401 enclosing a slightly smaller inner stepwise-tapered tubular member 402, such that the spacing between the outer and inner members forms an annular channel of progressively varying channel width between members and a progressively varying diameter for the working gas. In other words, the inner surface of the outer member 401 and the outer surface of the inner member 402 serve as spaced apart walls defining the channel.

The regenerator 400 has six sections 22–27 of progressively varying length, mean diameter, cross-sectional channel area and channel wall spacing, with the lowest temperature section 22 having the largest length and wall thickness and the smallest channel wall spacing and mean diameter (lateral extent), and the highest temperature section 27 having the smallest length and wall thickness and the largest channel spacing and mean diameter (lateral extent). Each of the regenerator sections 22–27 is comprised of concentric cylinders of constant diameters, wall thickness and spacing, as shown in the cross-sectional views of those section in FIG. 4. The length, channel wall spacing (channel width), the thicknesses of the walls of the outer and inner members 401 and 402, the cross-sectional channel areas and the mean channel diameter of the six sections 22–27 of the regenerator 400 are all tabulated in Table II. The mean circumference of the channel in each section is tabulated in Table II as the "lateral extent" E.

The outer and inner members 401 and 402 of the four lowest temperature sections 22–25 of the regenerator are advantageously fabricated from a lead alloy containing 0.1% to 1% of cesium or bismuth, while the two sections 26 and 27 situated closest to the compression bellows (i.e., the highest temperature section) are advantageously fabricated from stainless steel. In the alternative, the two sections 26 and 27 closest to the compression bellows may comprise rolled corrugated stainless steel foil 404 enclosed within tubular stainless steel walls 405, as shown in cross-sectional views 34 and 35 in FIG. 4 and in greater detail in FIG. 10. For such sections, the combined cross-sectional area A of the channel and wall members may be expressed as $$A=(2d_f+w)E, \tag{155}$$

where $d_f$ is the thickness of the foil and w and E are the channel width and the channel lateral extent, as given in Table II. The construction of rolled corrugated foil regenerator sections in accordance with the present invention is further described hereinbelow.

Figure 5:
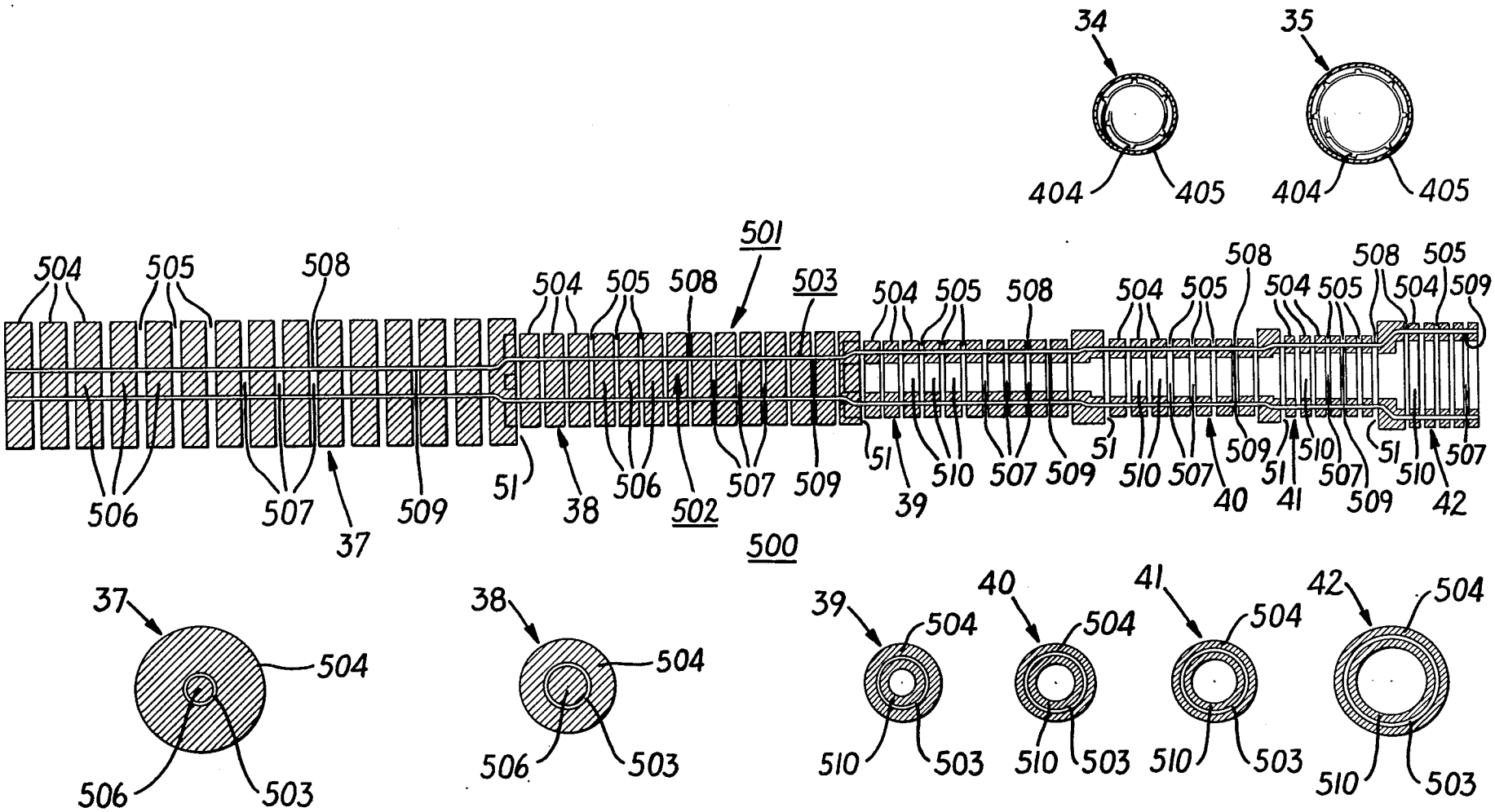
FIG. 5 shows a longitudinal sectional view of a regenerator for a Stirling cycle machine according to another embodiment of the present invention, and transverse sectional views of each of the sections of the regenerator, including alternative constructions for the two highest temperature sections.

Turning now to FIG. 5, there is shown a longitudinal sectional view of a regenerator 500, according to another embodiment of the present invention. The regenerator 500 is similar to that of FIG. 4 in that it is comprised of a generally tubular outer member 501 enclosing an inner member 502 to form an annular channel of progressively varying diameter in the space 503 between the members 501 and 502, and the regenerator 500 has six sections 37–42 of progressively varying length, channel wall spacing and cross-sectional channel area. However, the outer and inner members 501 and 502 of the regenerator 500 are each fabricated with alternating segments of high heat mass, high thermal conductivity material 504 and 505 and segments of low heat mass, low thermal conductivity material 505 and 507. The high heat mass, high thermal conductivity segments of the outer member 501 comprise regularly spaced annular metal bands 504 formed around the exterior surface of a stepwise tapered outer thin metal foil tubing 508, and the low heat mass, low thermal conductivity segments 505 of the outer member comprise the regions of the outer thin metal foil tubing between the metal bands 504. The high heat mass, high thermal conductivity sections of the inner member 502 comprises regularly spaced annular metal disks 506 or bands 510 formed in the interior of an inner stepwise tapered thin foil metal tubing 509, and the low heat mass, low thermal conductivity segments 507 of the inner member 502 comprise the regions of the inner thin metal foil tubing between the metal disks and bands 506 and 510. Cross-sectional views of each of the sections 37–42 of the regenerator 500 are also shown in FIG. 5.

The outer and inner thin metal foil tubings 508 and 509 are advantageously fabricated from brass in the two lowest temperature sections 37 and 38 and from stainless steel in the remaining four sections 39–42. The tubings 508 and 509 have a uniform thickness of approximately 0.0025 cm. The metal bands 504 and 510 or metal disks 506 backing the tubing walls are advantageously fabricated from lead in the three lowest temperature sections 36–38 and from lead or copper in the remaining sections.

Figure 10:
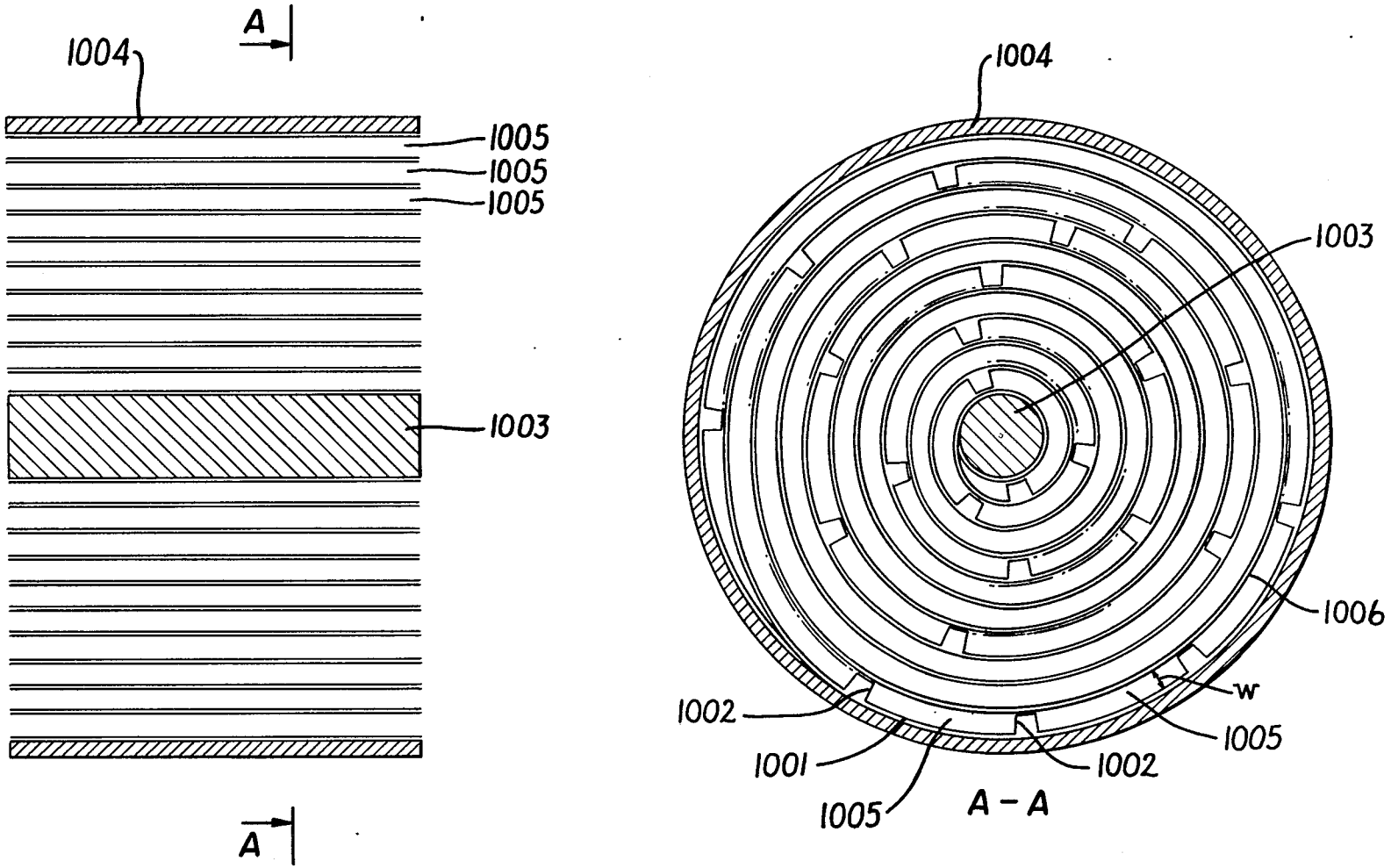
FIG. 10 shows longitudinal and transverse sectional views of a multiple channel regenerator section formed with rolled corrugated and smooth foils enclosed within tubular walls.

The two sections 41 and 42 of the regenerator 500 closest to the compression bellows may alternatively comprise rolled corrugated stainless steel foil enclosed within tubular stainless steel walls, as shown in cross-sectional views 34 and 35 in FIG. 5 and in greater detail in FIG. 10. For such sections, the combined cross-sectional area A of the channel and the wall members is given by equations (155), where the channel width w and the channel lateral extent E for those sections are given in Table III. The construction of rolled corrugated foil regenerator sections in accordance with the present invention is further described hereinbelow.

Figure 6:
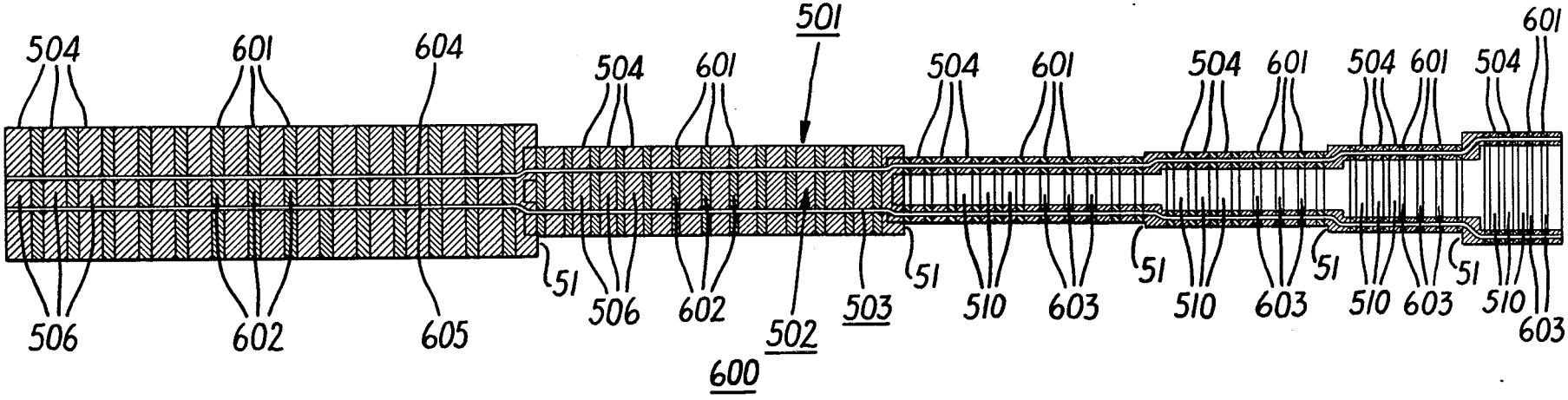
FIG. 6 shows a longitudinal sectional view of a regenerator for a Stirling cycle machine according to still another embodiment of the present invention.

Referring now to FIG. 6, there is shown an alternative construction for a segmented regenerator 600 similar to that shown in FIG. 5. However, in the regenerator 600 the low heat mass, low thermal conductivity segments 601, 602 and 603 of the outer and inner members 501 and 502 comprise annular bands 601, 603 or disks 602 of a solid insulating material, such as glass, glass foam or plastic. Since the alternating metal and solid insulating segments of the outer and inner members 501 and 502 can be formed to provide smooth channel walls 604 and 605 for the working gas, the thin metal foil tubing 508 and 509 used in the regenerator construction of FIG. 5 are not needed.

Figure 7:
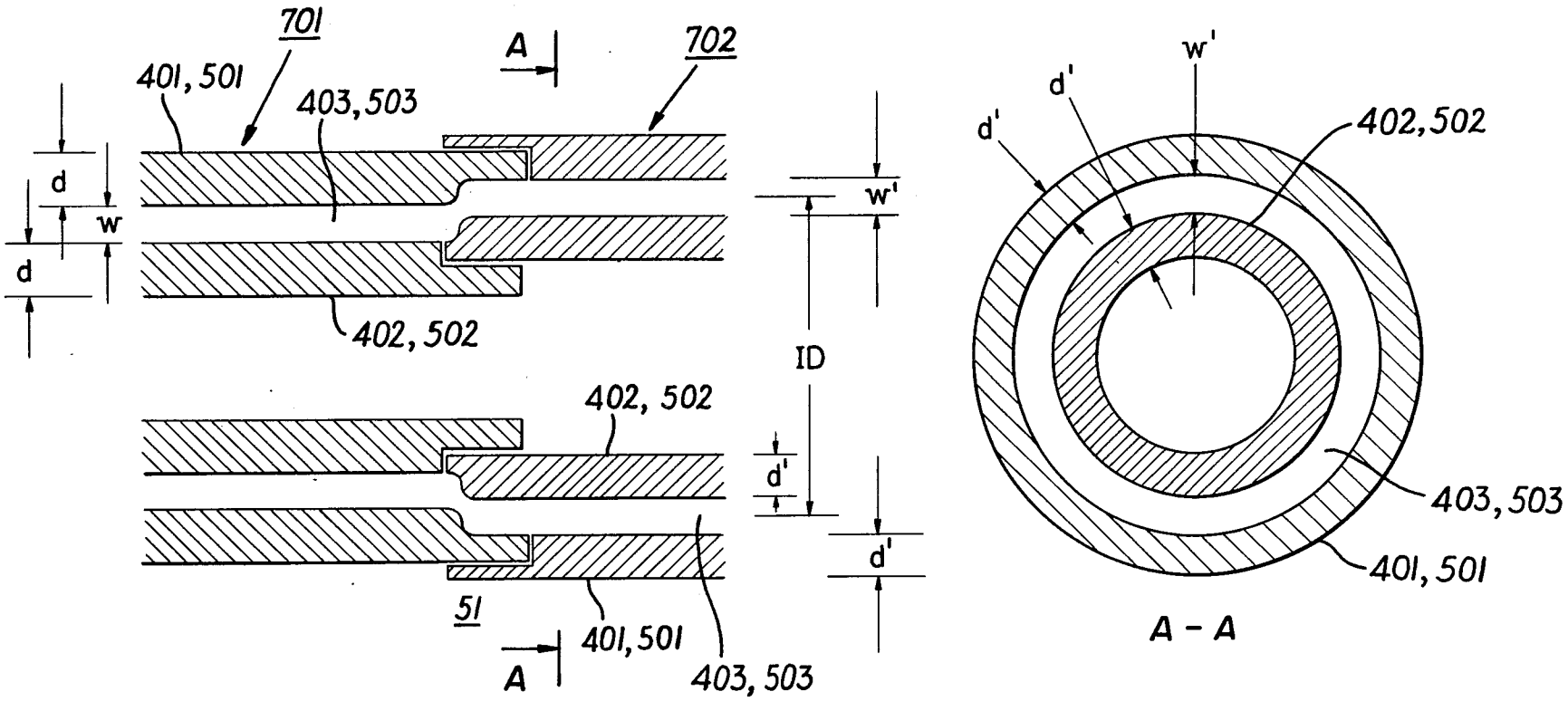
FIG. 7 shows longitudinal and transverse sectional views of an exemplary transition region between two annular channel sections of a regenerator in accordance with the present invention.

The channels 403 and 503 of the regenerators of FIGS. 4, 5 and 6 are joined section to section by a small transition region 51, which provides a smooth stepwise change in the diameters of the outer and inner tubular members 401, 501 and 402, 502. Referring now to FIG. 7, there is shown a longitudinal sectional view of an exemplary transition region 51 between two sections with annular channels and a transverse sectional view of the transition along the line 7—7 of the longitudinal sectional view of the same figure. The channel widths w and w′ and the channel wall thickness d and d′ of the two sections 701 and 702 being joined by the transition 51 are tabulated in Table II or III. The mean diameter of the channel, ID, may be computed from the quantity E tabulated in Table II or III by multiplying E by the input power (56 watts) and dividing by $\pi$. The joint 51 between sections has an overlap so that the transition in channel width and mean channel diameter is smooth with rounded edges.

Figure 8:
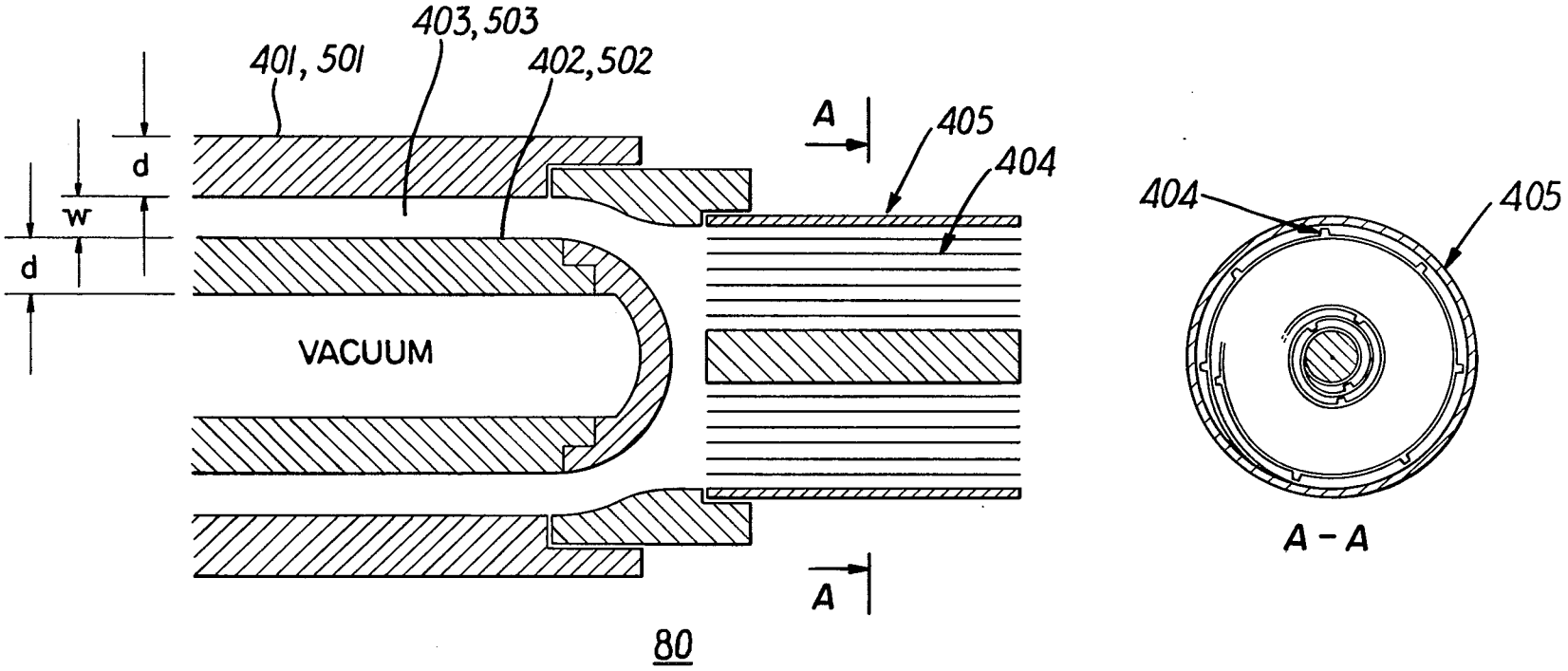
FIG. 8 shows longitudinal and transverse sectional views of an exemplary transition region between an annular channel section and a rolled foil section of a regenerator in accordance with the present invention.

Turning now to FIG. 8, there is shown a longitudinal section view of an exemplary transition region 800 between a section having an annular channel and a section having channels formed by rolled corrugated foil. Also shown in FIG. 8 is a transverse sectional view of the transition along line A—A of the longitudinal sectional view of the same figure. The transitional region 800 provides a smooth interface between the annular channel 403, 503 defined by the outer and inner tubular members, 401, 501 and 403 and 503, and the channels defined by the stainless steel foil 404.

Figure 9:
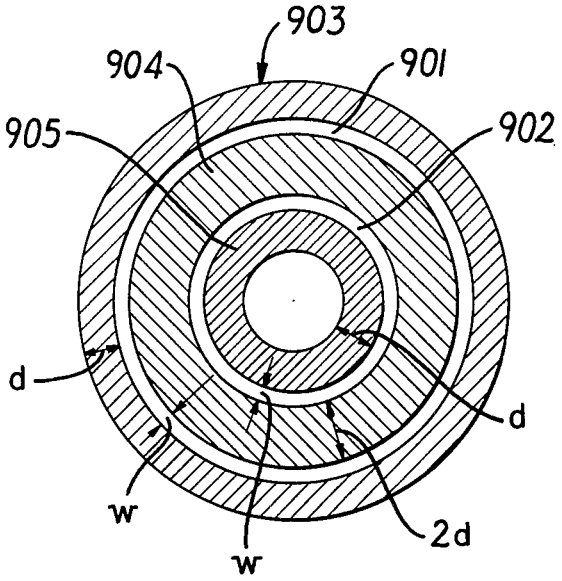
FIG. 9 shows a transverse sectional view of a regenerator section having two nested channels formed by three coaxial tubular members.

Since the oscillatory frequency of the working gas flow is specified in the design and optimization for the regenerator, for a single channel regenerator formed by a pair of stepwise tapered tubular members, the cooling power is limited by the smallest cross-sectional area of the channel, i.e., that of the lowest temperature section. If a larger cooling power is required, the total channel cross-sectional area must be increased. This is preferentially achieved in accordance with the present invention by a regenerator construction in which plural nested channels are formed with multiple, coaxial, stepwise-tapered tubular members. An example of such a regenerator construction having two nested channels 901 and 902 formed by coaxial tubular members 903, 904 and 905 is shown in sectional view in FIG. 9. The tubular members 903, 904 and 905 may have the same construction as those used in the regenerator of FIGS. 4, 5 or 6.

In each section, the nested channels 901 and 902 have the same width w, and the wall members have the same thickness d of heat capacity material. The values of w and d may be taken from Table II or III, depending on the construction of the wall members. It is noted that the outermost and innermost tubular members 903 and 905 have the same heat capacity material thickness d, but the middle tubular member 904 which serves both channels 901 and 902, has a heat capacity material thickness of 2d.

An alternative construction for a multiple channel regenerator in accordance with the present invention is illustrated in FIG. 10. Referring to FIG. 10, a foil 1001 having regularly spaced, uniform height corrugations 1002 is rolled around a mandrel 1003 and enclosed within tubular walls 1004 so as to form channels 1005 of nearly uniform width, w, and length, L. The values of w and L may be taken from Table II or III for each section of the regenerator, depending upon the construction of the foil 1001. The height of the corrugations 1002 of the foil 1001 in each regenerator section is made equal to the channel width specified for that section. Since the channel width uniformity is interrupted by the corrugations 1002 and deviations from channel width uniformity lowers the efficiency of the channel, the spacing between the corrugations must be large (e.g., a factor of of 5 to 6 greater) in relation to the height of the corrugations in order to maintain a high channel efficiency. For example, if the channel width varies from $5\times10^{-3}$ to $1.3\times10^{-2}$ cm, the spacing between the corrugations 1002 should be on the order of 1 mm. It is noted that in FIG. 10, the spacing between the corrugations 1002 is exaggerated for simplicity of the depiction. In order to prevent the corrugations 1002 from meshing with one another, it is advantageous to roll the corrugated foil 1001 together with a smooth foil 1006, such that each channel 1005 is bounded by the two foils 1001 and 1006. The two foils 1001 and 1006 have the same thickness of heat capacity material, as specified in Table II or III for each section of the regenerator.

Figure 11:
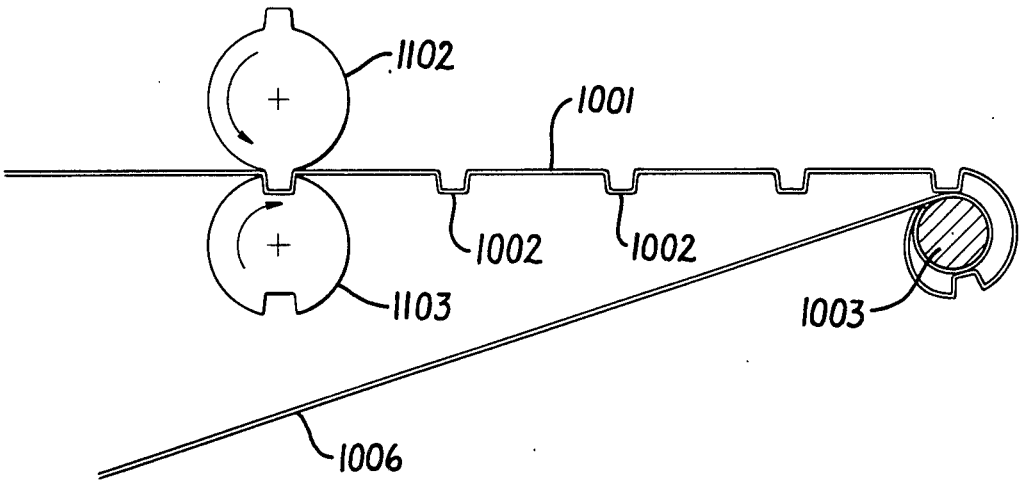
FIG. 11 schematically illustrates an exemplary technique for fabricating the rolled foil for the regenerator section of FIG. 10.

An exemplary technique for fabricating the rolled corrugated foil regenerator sections of the present invention is schematically illustrated in FIG. 11. Referring to FIG. 11, the corrugated foil 1001 is formed by rolling a smooth foil between a pair of counter-rotating rolls 1102 and 1103, which have appropriately positioned counterpart elevations and grooves. The corrugated foil 1001 thus formed is wound around a mandrel 1003 together with a smooth foil 1006. It is noted that the corrugations 1002 may have any cross-sectional shape; however, a square cross-section is preferred.

Figure 12:
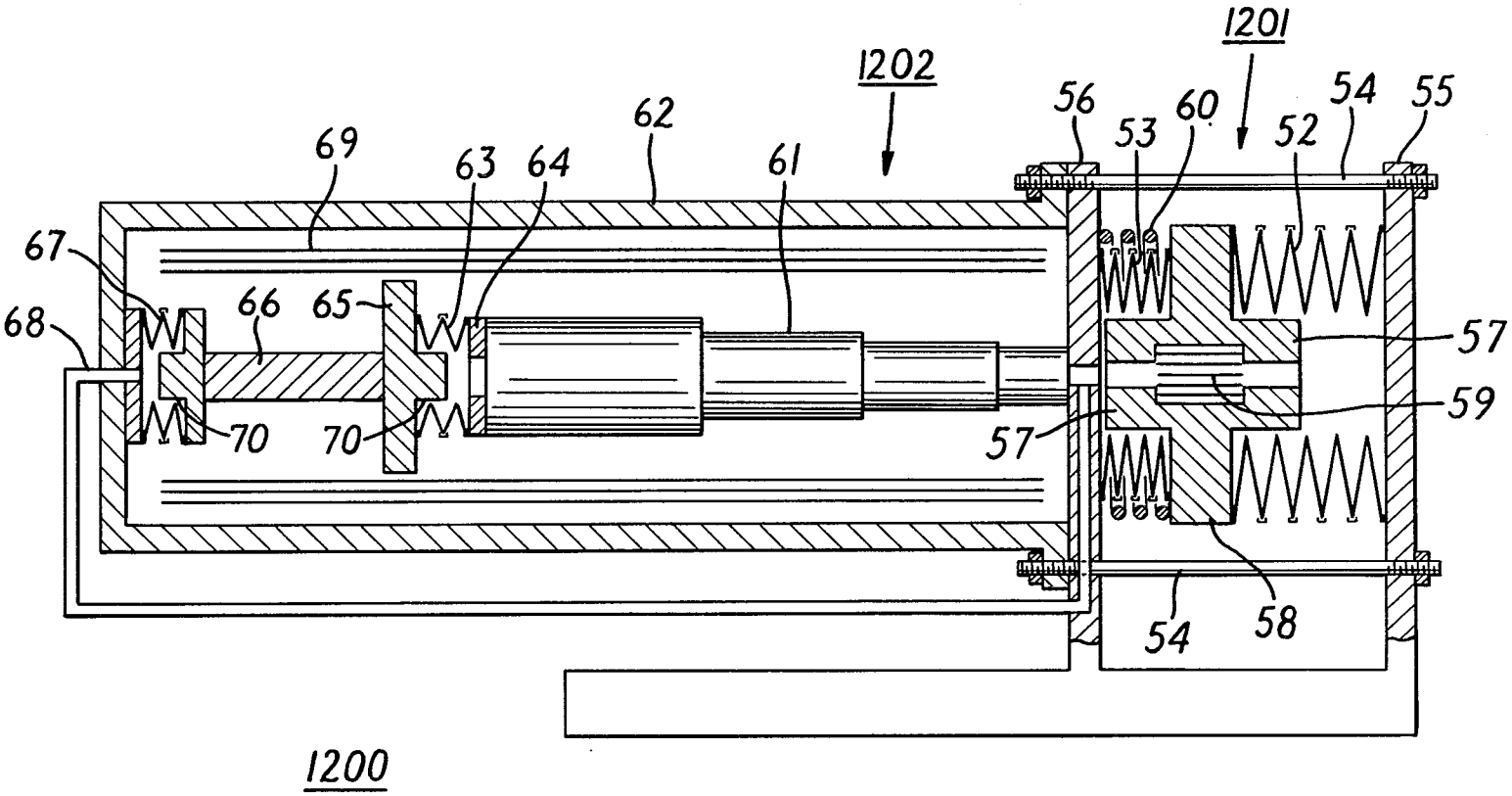
FIG. 12 is a longitudinal sectional view of an entire Veullimier cycle machine in accordance with the present invention.

Referring now to FIG. 12, there is shown a longitudinal sectional view of a Veullimier cycle machine 1200 in accordance with the present invention. In the Veullimier cycle, two isothermal bellows 52 and 53 having nearly equal displacement volumes are constrained by rods 54 and stationary end plates 55 and 56. A central divider 58 having zero volume displacement pucks 71 and 57 for the two bellows 52 and 53, respectively, and a rolled corrugated foil regenerator 59 is allowed to oscillate between the two bellows 52 and 53, such that a displacement of the divider 58 relative to the rods 54 and the end plates 55 and 56 results in substantially no change in volume. Therefore, a gas contained by the bellows 52 and 53 can be displaced back and forth between the two bellows with virtually no work being required. The regenerator 59 may have the same design as the high temperature end sections 34 and 35 of the regenerators of FIGS. 4–6. The bellows 52 is maintained at a relatively high temperature $T_1$ by an external heat source, such as a hot air blower (not shown), and the bellows 33 is maintained at ambient temperature by appropriate cooling means, such as a fan (not shown). Hence, the gas pressure is larger by a factor of $T_1/T_2$ when all the gas is displaced into the hotter bellows 52, and the gas pressure is smaller by a factor of $T_1/T_2$ when all the gas is displaced into the cooler bellows 53. Consequently. if the divider 58 is made to oscillate between the two bellows 52 and 53, the gas pressure contained by the bellows also oscillates. In the Veullimier cycle machine 1200, the oscillating gas pressure is used to drive a Stirling refrigeration cycle. Therefore, the combination of the bellows 52 and 53 and the divider 58 serves as a driving system 1201 for the refrigeration cycle.

Since a very small amount of mechanical work is required to displace a gas between the bellows 52 and 53 compared to the relatively large heat energy that is exchanged as the gas is alternately heated and cooled in the bellows 52 and 53, respectively, a small fraction of the work that results from the oscillating pressure in the bellows may be used to drive the oscillating divider 58. This is accomplished by making the hotter bellows 52 slightly larger (less than 5%) than that of the cooler bellows 53. A coil spring 60 wound around the cooler bellows 53 is provided to balance the greater force of expansion of the hotter bellows 52, owing to its larger cross-sectional area. The mechanical drive for the oscillation of the divider 58 is generated as a result of a slight time delay in the heating of the gas in the hotter bellows 52 relative to the displacement. The time delay causes mor work to be added to the expansion phase of the cycle than the compression phase. The difference in work caused by the time delay is stored in the spring 60 and returned during the compression phase of the next cycle. Therefore, the oscillation of the divider 58 is self-sustaining, because a small fraction of the oscillating energy is phase shifted and fed back to drive the oscillation.

The frequency of oscillation of the divider 58 is determined by its mass, the restoring force of the spring 60 and the difference in cross-sectional area between the hotter and cooler bellows 52 and 53 multiplied by the gas pressure.

The oscillating gas pressure in the bellows 52 and 53 is used to drive a Stirling cycle refrigerator 1202 comprising compression bellows 53, expansion bellows 63 and a regenerator 61. Since the divider 58 can be made relatively massive and the restoring force of the spring 60 needed to balance the extra cross-sectional area of the hotter bellows 52 is relatively small, the oscillation frequency can be made relatively low, e.g., 15 to 30 Hz, so as to provide a suitable operating frequency for a Stirling cycle refrigerator 1202 having a compression bellows 53, an expansion bellows 63 and a regenerator 61 in accordance with the present invention. The construction of the regenerator 61 may be as illustrated in FIG. 4, 5 or 6.

The operating frequency of the refrigeration cycle must be 90° out of phase with the frequency of the driving system 1202. For that reason, springs and masses are used in the refrigerator 1202 to obtain the phase difference, so that an oscillating heat pump 1202 is achieved which is driven solely by input heat provided to the driving system 1201.

The high temperature end of the regenerator 61 is attached to a stationary plate 56, which also serves as the end cap of a vacuum vesel 62 for providing thermal insulation for the regenerator and the expansion bellows 63. The expansion bellows 63, which is appropriately scaled in cross-sectional area and stroke, is attached to one side to the cold end of the regenerator 61 by means of a stationary plate 64. The other side of the compression bellows 63 is attached to a moving plate 65, which supplies nearly all of the mass for the oscillating portion of the refrigerator 1202. The cross-sectional area of the expansion bellows 63 is smaller than that of the compression bellows 53 by the aforementioned ratio $(T_2/T_3)^{\frac{1}{2}}$.

The force exerted by the expansion bellows 63 when it expands is balanced by a spring bellows 67, which is coupled to the compression bellows 63 through an insulating rod 66. The spring bellows 67 is in communications with the compression bellows 53 through a small bleed pressure line 68, which allows pressure balance back to the compression bellows 53. The spring constant of the spring bellows 67 and the mass of the oscillating portion of the refrigerator 1202, which is primarily in the movable end plate 65, results in a resonant frequency that is close to the driving frequency, i.e., the oscillating frequency of the driving system 1201. By making the trapped gas pressure in the spring bellows 67 to be slightly less than the mean gas pressure in bellows 52, 53 and 63, the resonant frequency of the oscillating portion of the refrigerator 1202 can be shifted to slightly less (e.g., 10% lower) than the drive frequency to permit the refrigerator 1202 to be driven by power from the driving system 1201. The regenerator 61 is surrounded by super-insulation 69, and zero displacement pucks 70 and 72 are provided for the expansion bellows 63 and the spring bellows 67, respectively.

It will be understood that various modifications or alternations may be made to the foregoing exemplary embodiment by one skilled in the relevant arts without departing from the spirit or scope of the invention as defined in the appended claims.

I claim:

1. A Stirling cycle machine comprising: first and second variable-volume, compression-expansion chambers containing a gas; a regenerator interconnecting the first and second chambers for conducting the gas therebetween; and means for driving the first and second chambers, the regenerator having one or more channels each defined by spaced-apart channel walls supported by wall members having a relatively low longitudinal thermal conductivity and comprising a heat capacity material of a relatively high specific heat, the regenerator having a plurality of longitudinal sections of predetermined length, the channels having a uniform predetermined channel wall spacing and thickness of the heat capacity material in each section, wherein the machine is adapted to operate with the gas in the first chamber at a higher temperature than the gas in the second chamber and the length of each section and the thickness of the heat capacity material in each section progressively decrease in the direction from the second chamber to the first chamber and the spacing of the channel walls and the lateral extent of the channels in each section progressively increase in the direction from the second chamber to the first chamber.

2. A Stirling cycle machine according to claim 1, wherein the wall members in at least a portion of each channel comprise a stepwise-tapered tubular outer member enclosing a stepwise-tapered inner member, the outer and inner members being sized, positioned and shaped such that an inner surface of the outer member and an outer surface of the inner member define the channel and serve as the channel walls.

3. A Stirling cycle machine according to claim 2, wherein at least a portion of the regenerator has a plurality of nested annular channels formed by a multiplicity of coaxial, stepwise-tapered tubular members including an outermost member and an innermost member, the outermost and innermost tubular members having substantially the same thickness of heat capacity material in each section and the other ones of the coaxial tubular members having substantially twice the thickness of heat capacity material of the outermost and innermost members.

4. A Stirling cycle machine according to claim 1, wherein the regenerator includes one or more sections each having a plurality of channels formed by a rolled foil having regularly spaced, parallel corrugations of uniform height enclosed within tubular walls, the height of the corrugations in each section being substantailly equal to the predetermined spacing of the channel walls for the section, the foil comprising heat capacity material of the predetermined thickness for the section and the separation between the corrugations being large compared to the height thereof.

5. A Stirling cycle machine according to claim 4, wherein the foil having the corrugations is rolled around a mandrel with another foil having smooth surfaces, the other foil also comprising heat capacity material of the predetermined thickness for the section.

6. A Stirling cycle machine according to claim 5, wherein each of the corrugations of the foil in each section has an approximately square cross-section.

7. A Stirling cycle machine according to claim 1, wherein during operation of the machine, the gas in at least one section of the regenerator is in the range of 1° K. to 10° K. and the wall members forming each channel of the regenerator are made of a substantially uniform heat capacity material of a relatively high specific heat and each have a predetermined thickness in each section to provide a thermal conductivity given approximately by $$0.1T^{-\frac{1}{2}}P^{\frac{1}{2}}\text{cal cm °K}^{-1}\text{ s}^{-1},$$

where T and P are respectively the mean operating temperature and mean operating pressure of the gas in the section in degrees Kelvin and atmospheres.

8. A Stirling cycle machine according to claim 1, wherein the length of each section of the regenerator is given approximately by $$20T^{-\frac{1}{2}}\ cm,$$

where T is the mean operating temperature of the gas in the section in degrees Kelvin.

9. A Stirling cycle machine according to claim 1, wherein the spacing between the channel walls in each section of the regenerator is given approximately by $$0.004T^{\frac{1}{2}P-\frac{1}{2}}\text{ cm},$$

where T and P are respectively the mean operating temperature and mean operating pressure of the gas in the section in degrees Kelvin and atmospheres.

10. A Stirling cycle machine according to claim 1, wherein the thickness of the heat capacity material of the wall members in each section of the regenerator is given approximately by $$20T^{-7/4}P^{\frac{1}{2}} \text{ cm},$$

where T and P are respectively the mean operating temperature and the mean operating pressure of the gas in the section in degrees Kelvin and atmospheres.

11. A Stirling cycle machine according to claim 1, wherein the lateral extent of each channel in each section of the regenerator is given approximately by $$7.3T^{-\frac{3}{4}}P^{-1}(\text{pwr}) \text{ cm},$$

where T, P and pwr are respectively the mean operating temperature and the mean operating pressure of the gas in the section and the average input power of the machine in degrees Kelvin, atmospheres and watts.

12. A Stirling cycle machine according to claim 1, wherein the lengths of the section of the regenerator are infinitesimally small such that the spacing between channel walls, and the thickness of the heat capacity material of the wall members are continuously varying along the regenerator.

13. A Stirling cycle machine according to claim 1 wherein the mean gas temperature in the regenerator varies from stage to stage by approximately a 2:1 ratio.

14. A Stirling cycle machine according to claim 1, wherein the material of the wall members forming each channel is a lead alloy including bismuth in the proportion of 0.1% to 1.0%.

15. A Stirling cycle machine according to claim 1, wherein the material of the wall members forming each channel is a lead alloy including cesium in the proportion of 0.1% to 1.0%.

16. A Stirling cycle machine according to claim 1, wherein the first and the second chambers respectively comprise a first and a second isothermal bellows, each having a plurality of convolutions, the first and second bellows being driven in compression-expansion strokes in an appropriate phase relationship such that the machine functions as an isothermal heat pump.

17. A Stirling cycle machine according to claim 16, wherein the first and second bellows are driven at a frequency in the range of 10 to 30 Hz.

18. A Stirling cycle machine according to claim 16, wherein the first and second bellows have displacement volumes $V_1$ and $V_2$, respectively; the ratio $V_1/V_2$ is approximately equal to $T_1/T_2$, where $T_1$ and $T_2$ are respectively the temperatures of the gas in the first and second chambers in degrees Kelvin; the numbers of convolutions of the first and second bellows are $N_1$ and $N_2$, respectively; the lengths of the strokes of the first and second bellows are $l_1$ and $l_2$, respectively; and the ratios $N_1/N_2$ and $l_1/l_2$ both lie between $(T_1/T_2)^{\frac{1}{2}}$ and $(T_1/T_2)^{\frac{1}{3}}$.

19. A Stirling cycle machine according to claim 16, wherein the first and second bellows and the regenerator are vertically disposed with the first bellows positioned above the regenerator and the second bellows positioned below the regenerator, the first bellows having an upper end attached to a first movable divider and a lower end attached to a stationary divider connected to the regenerator and having an aperture therein to permit communication between the first bellows and the regenerator, the second bellows having an upper end connected to the regenerator and a lower end attached to a first movable plate, and further comprising a third isothermal bellows positioned above the first bellows for containing gas at a third temperature, the third bellows having an upper end attached to a first stationary member, a lower end attached to the first movable divider and a cross-sectional area larger than that of the first bellows; a second regenerator carried by the first movable divider for interconnecting the first and third bellows and transferring gas therebetween; first spring means including a second movable plate and an insulating member for exerting a resilient force against the first movable plate; and second spring means for exerting a resilient force between the stationary and movable dividers, whereby if the third temperature is sufficiently greater than the first temperature, a first self-sustaining oscillation of the movable divider is established, the first oscillation of the movable divider driving a second oscillation of the first and second movable plates and the insulating member, wherein the masses of the first and second plate members and the insulating member and the spring constant of the first spring means are adjusted such that the second oscillation is approximately 90° out of phase with the first oscillation.

20. A Stirling cycle machine according to claim 19, wherein the first spring means comprises a spring bellows positioned below the second bellows and a bleed pressure return line interconnecting the spring bellows and the first bellows, the spring bellows having an upper end attached to the second movable plate and a lower end attached to a second stationary member, the second movable plate being coupled to the first movable plate by the insulating member, and the second spring means comprises a coil spring interposed between the movable and stationary dividers and coaxially surrounding the first bellows.

21. A Stirling cycle machine according to claim 1, wherein the wall members each comprise alternating first and second segments, the first segments being made of a heat capacity material of a relatively high thermal conductivity and a relatively high heat mass, the second segments being made of a material of a relatively low thermal conductivity and a relatively low heat mass, the first segments of one wall member being oppositely disposed with respect to those of the other.

22. A Stirling cycle machine according to claim 21, wherein the first segments of the wall members are made of heat conducting metal and the second segments of the wall members are made of a heat insulating material, and the wall members have smooth opposing surfaces serving as the channel walls in each section.

23. A Stirling cycle machine according to claim 22, wherein the first and the second segments have respective predetermined lengths, the ratio of the length of a first segment to the length of a second segment is approximately 10:1 and in each section of the regenerator the wall members each have at least 10 first segments.

24. A Stirling cycle machine according to claim 22, wherein the heat conducting metal is lead.

25. A Stirling cycle machine according to claim 22, wherein the heat insulating material comprises glass foam.

26. A Stirling cycle machine according to claim 24, wherein the machine is adapted to operate at a frequency of approximately 15 Hz and the thickness of the lead regions in each section are given approximately by $$16.5T^{-7/4} \text{ cm for } T<20° \text{ K.},$$

$0.19T^{-\frac{1}{2}}$ cm for 20° K.<T<32° K., and 0.05 cm for T<32° K., where T is the mean operating temperature of the gas in the section in degrees Kelvin.

27. A Stirling cycle machine according to claim 21, wherein the wall members each comprise a relatively thin, continuous material of a relatively low thermal conductivity having one surface serving as the channel wall and another surface backed by regularly spaced-apart strips of a heat capacity material having a relatively high thermal conductivity in thermal contact with the relatively thin material, each of the first segments of the wall members comprises the relatively thin material backed by one of the strips of the relatively high thermal conductivity material, and each of the second segments of the wall members comprises the relatively thin material in between two strips of the relatively high thermal conductivity material.

28. A Stirling cycle machine according to claim 27, wherein the relatively thin material of the wall members is stainless steel having a thickness in the range of 0.001 to 0.002 cm and the strips of heat capacity material of the first segments is lead.

29. A Stirling cycle machine according to claim 27, wherein the relatively thin material of the wall members is brass having a thickness in the range of 0.001 to 0.002 cm and the strips of heat capacity material of the first segments is lead.

30. A Stirling cycle machine according to claim 29, wherein the strips of heat capacity material of the first segments is lead for regions of the channel in which the temperature of the gas during operation is less than or equal to approximately 50° K. and is copper for regions of the channel in which the temperature of the gas during operation is greater than approximately 50° K.

* * * * *